US008931298B2

(12) United States Patent
Sekine

(10) Patent No.: US 8,931,298 B2
(45) Date of Patent: Jan. 13, 2015

(54) AIR CONDITIONER

(75) Inventor: Takashi Sekine, Ota (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 738 days.

(21) Appl. No.: 12/868,318

(22) Filed: Aug. 25, 2010

(65) Prior Publication Data

US 2011/0048053 A1 Mar. 3, 2011

(30) Foreign Application Priority Data

Aug. 28, 2009 (JP) ..... 2009-198536
Aug. 28, 2009 (JP) ..... 2009-198537

(51) Int. Cl.

*F25B 5/00* (2006.01)
*F25B 27/00* (2006.01)
*F25B 13/00* (2006.01)
*F25B 41/04* (2006.01)

(52) U.S. Cl.

CPC ..... *F25B 13/00* (2013.01); *F25B 41/046* (2013.01); *F25B 2313/007* (2013.01); *F25B 2313/0231* (2013.01); *F25B 2313/0253* (2013.01); *F25B 2313/02742* (2013.01); *F25B 2400/075* (2013.01)

USPC ..... 62/324.6; 62/238.7; 62/117

(58) Field of Classification Search

USPC ..... 62/324.6, 324.1, 160, 238.7, 442
See application file for complete search history.

(56) References Cited

U.S. PATENT DOCUMENTS 4,878,357 A * 11/1989 Sekigami et al. ..... 62/160
5,490,399 A * 2/1996 Sada ..... 62/510
5,526,649 A * 6/1996 Sada ..... 62/175

FOREIGN PATENT DOCUMENTS

JP 06-074598 A 3/1994
JP 06-257875 A 9/1994
JP 06-317360 A 11/1994
JP 2804527 B2 9/1998
JP 2006-125716 A 5/2006

OTHER PUBLICATIONS

Japanese Office Action dated Apr. 30, 2013, issued in corresponding Japanese Patent Application No. 2009-198537, with English translation (8 pages).

* cited by examiner

*Primary Examiner* — Judy Swann
*Assistant Examiner* — Zachary R Anderegg
(74) *Attorney, Agent, or Firm* — Westerman, Hattori, Daniels & Adrian, LLP

(57) ABSTRACT

A triple-pipeline type first outdoor unit 2 connected to three inter-unit pipelines 5 made up of a high-pressure gas pipe 7, a low-pressure gas pipe 6, and a fluid pipe 8 and a second outdoor unit 3 connected by two pipelines of a gas pipe 35 and a fluid pipe 36 are provided, in which a fluid pipe 36 of this second outdoor unit 3 is connected to the fluid pipe 8, while a gas pipe 35 of the second outdoor unit is selectively connected to the high-pressure gas pipe 7 or the low-pressure gas pipe 6 using a valve-element kit 50 having a four-way valve 51.

6 Claims, 12 Drawing Sheets

AIR CONDITIONER

INCORPORATION BY REFERENCE

The present application claims priority under 35 U.S.C. §119 to Japanese Patent Application No. 2009-198536 filed on Aug. 28, 2009 and Japanese Patent Application No. 2009-198537 filed on Aug. 28, 2009. The content of the applications is incorporated herein by reference in its entirety.

BACKGROUND OF INVENTION

1. Technical Field

The present invention relates to an air conditioner having an outdoor unit and a plurality of indoor units, in which the plurality of indoor units can perform a cooling operation or a heating operation at the same time or the heating operation and the cooling operation can be performed in a mixed manner.

2. Background Art

In general, an air conditioner of a fluid pipe and a gas pipe connection type (hereinafter referred to as a "double pipeline type") is known in which an outdoor unit and a plurality of indoor units are connected through two inter-unit pipelines made up of a fluid pipe and a gas pipe and the plurality of indoor units are made to perform the cooling operation or the heating operation. Also, recently, an air conditioner of a low-pressure gas pipe, a high-pressure gas pipe and a fluid pipe connection type (hereinafter referred to as a "triple pipeline type") is proposed, in which the outdoor unit and the plurality of indoor units are connected through three inter-unit pipelines made up of a low-pressure gas pipe, a high-pressure gas pipe and a fluid pipe and the plurality of indoor units are made to perform the cooling operation or the heating operation at the same time or the cooling operation and the heating operation are performed in a mixed manner (See JP-B-2804527, for example).

With this type of triple-pipeline type air conditioner, there is a tendency that a plurality of outdoor units are provided in order to reduce the size of each outdoor unit and the number of outdoor units to be operated is adjusted according to an air-conditioning load so as to improve operation efficiency of various air-conditioning operations.

However, the outdoor unit used in the triple-pipeline type air conditioner is provided with a compressor, an outdoor heat exchanger, and an outdoor expansion valve in general and is constituted such that one end of the outdoor heat exchanger is selectively branched and connected to a refrigerant discharge pipe and a refrigerant sucking pipe of the compressor, a high-pressure gas pipe is connected to this refrigerant discharge pipe, a low-pressure gas pipe is connected to the refrigerant sucking pipe, and a fluid pipe is connected to the other end of the outdoor heat exchanger. Thus, configurations of devices connected by pipelines or routing of the pipelines in the triple-pipeline type outdoor unit are more complicated as compared with the double-pipeline type outdoor unit and that raises a development cost and a manufacturing cost, whereby a problem of a high price is caused in the configuration provided with a plurality of triple-pipeline type outdoor units.

On the other hand, to the outdoor unit used in the above-mentioned triple pipeline type air conditioner, the low-pressure gas pipe, the high-pressure gas pipe, and the fluid pipe need to be connected, by which a configuration of a refrigerant circuit is different from that of the double-pipeline type outdoor unit. Thus, the triple-pipeline type outdoor unit has more complicated configuration of devices connected by pipelines or routing of the pipelines as compared with the double-pipeline type outdoor unit, which tends to increase the size of the device configuration. Also, since the triple-pipeline type outdoor unit is independently developed and manufactured separately from the double-pipeline type outdoor unit, there are problems that a development period is extended, a manufacturing line should be newly provided, and a production cost is increased.

SUMMARY OF INVENTION

Thus, the present invention has an object to solve the above-mentioned problem and to provide an air conditioner in which a plurality of outdoor units are connected by three inter-unit pipelines, in which a part of the outdoor units are constituted inexpensively so as to reduce the price of the entire device.

In order to achieve the above object, the present invention is, in an air conditioner configured such that a first outdoor unit provided with a first compressor, a first outdoor heat exchanger, and a first outdoor expansion valve and a plurality of indoor units provided with indoor heat exchangers are connected by an inter-unit pipeline, one end of the first outdoor heat exchanger is selectively branched and connected to a refrigerant discharge pipe and a refrigerant sucking pipe of the first compressor, the inter-unit pipeline has a high-pressure gas pipe connected to the refrigerant discharge pipe, a low-pressure gas pipe connected to the refrigerant sucking pipe, and a fluid pipe connected to the other end of the first outdoor heat exchanger, one end of the indoor heat exchanger is selectively branched and connected to the high-pressure gas pipe and the low-pressure gas pipe, and the other end of the indoor heat exchanger is connected to the fluid pipe through a fluid branch pipe so that the plurality of indoor units can perform a cooling operation or a heating operation at the same time or the cooling operation and the heating operation can be performed in a mixed manner, characterized in that a second outdoor unit provided with a second compressor, a second outdoor heat exchanger, and a second expansion valve and connected by two pipelines of a gas pipe and a fluid pipe, the fluid pipe of the second outdoor unit being connected to the fluid pipe of the inter-unit pipeline, and the gas pipe of the second outdoor unit being selectively connected to the high pressure gas pipe or the low-pressure gas pipe of the inter-unit pipeline using a valve-element kit having a channel switching valve.

According to this configuration, since the so-called double-pipeline type second outdoor unit can be connected to the three inter-unit pipelines through the valve-element kit having the channel switching valve, a part of the outdoor units connected to the triple-pipeline type air conditioner can be constituted inexpensively using the existing double-pipeline type second outdoor unit, and the price of the entire air conditioner can be reduced.

Also, in this configuration, the valve-element kit may be so configured to be provided with a single four-way valve as the channel switching valve, in which the gas pipe is connected to a first port of this four-way valve, the low-pressure gas pipe is connected to a second port, the high-pressure gas pipe is connected to a third port, and a fourth port is closed or the low-pressure gas pipe is connected to the fourth port through a capillary tube. According to this configuration, with the simple configuration that the four-way valve is interposed, the gas pipe of the second outdoor unit can be selectively connected to the high-pressure gas pipe or the low-pressure gas pipe of the inter-unit pipeline, and the so-called double-pipeline type outdoor unit can be connected to the triple-pipeline type air conditioner.

Also, it may be so configured that the valve-element kit is provided outside a housing of the second outdoor unit. According to this configuration, since the existing double-pipeline type outdoor unit can be used as it is as the second outdoor unit without changing the pipeline configuration, the configuration of the triple-pipeline type air conditioner can be simplified.

Also, it may be so configured that the capacity of the first compressor is provided with the capacity of at least a half of all the compressors provided in the air conditioner. According to this configuration, in the case of the load balance of a cooling load and a heating load at 50%:50% during the cooling-heating mixed operation, the air-conditioning operation can be performed using the first outdoor unit provided with the first compressor, and if the cooling load or the heating load is increased and the load balance is changed, the excess load of the cooling load or the heating load can be borne by the second outdoor unit. Thus, however changed the load balance of the cooling load and the heating load during the cooling-heating mixed operation is, the air-conditioning operation with this load balance can be realized.

Also, it maybe so configured that the first outdoor unit is provided with a plurality of the first outdoor heat exchangers, one end of each first outdoor heat exchanger is connected to the refrigerant discharge pipe and the refrigerant sucking pipe through a refrigerant discharge pipe branch pipe and a refrigerant sucking pipe branch pipe, respectively, and an electromagnetic opening/closing valve is disposed at the refrigerant discharge pipe branch pipe and the refrigerant sucking pipe branch pipe, respectively. According to this configuration, since an operation of each electromagnetic opening/closing valve can be controlled by the load balance of the cooling load and the heating load during the cooling-heating mixed operation so as to change the number of the first outdoor heat exchangers used in the air-conditioning operation, the operation efficiency during the air-conditioning operation can be improved by changing the number of the first outdoor heat exchangers as appropriate.

Also, it may be so configured that one ends of the indoor heat exchangers are connected to the high-pressure gas pipe and the low-pressure gas pipe through a high-pressure gas branch pipe and a low-pressure gas branch pipe, respectively, and an electromagnetic opening/closing valve is disposed at the high-pressure gas branch pipe and the low-pressure gas branch pipe, respectively.

Also, the present invention has an object to solve the above-mentioned problems and to provide an air conditioner in which the size of an outdoor unit to which three inter-unit pipelines can be connected is reduced and a production cost is lowered.

In order to achieve the above objects, the present invention is provided with a first outdoor unit having a first compressor, a first four-way valve, and a first outdoor heat exchanger, an inter-unit pipeline having a high-pressure gas pipe branching from between the first compressor and the first four-way valve, a low-pressure gas pipe connected to a refrigerant sucking pipe of the first compressor, and a fluid pipe connected to the first outdoor heat exchanger, and a plurality of indoor units connected to the high-pressure gas pipe, the low-pressure gas pipe, and the fluid pipe of the inter-unit pipeline and having indoor heat exchangers, characterized in that the first four-way valve makes the low-pressure gas pipe and the first outdoor heat exchanger communicate with each other at a first switching position and makes the first compressor and the first outdoor heat exchanger at a second switching position communicate with each other.

According to this configuration, since the first outdoor unit connected to the three inter-unit pipelines can be configured using the so-called double-pipeline type existing outdoor unit having the compressor, the four-way valve, and the outdoor heat exchanger, the production cost can be reduced as compared with the case of the separate development of the triple-pipeline type outdoor unit. Also, since the first outdoor unit is constituted on the basis of the so-called double-pipeline type outdoor unit, the size reduction of the first outdoor unit can be realized as compared with the case of the prior-art triple-pipeline type outdoor unit.

In this configuration, it may be so configured that a refrigerant discharge pipe of the first compressor is connected to a first port of the first four-way valve, the first outdoor heat exchanger is connected to a second port, the refrigerant sucking pipe is connected to a third port, a fourth port is closed or the refrigerant sucking pipe is connected to the fourth port through a capillary tube. According to this configuration, the first compressor, the first outdoor heat exchanger, the high-pressure gas pipe, and the low-pressure gas pipe can be connected through the first four-way valve, and by switching the first four-way valve to the first switching position and the second switching position, the plurality of the indoor units can be easily made to perform the cooling operation or the heating operation at the same time or the heating operation and the cooling operation can be performed in a mixed manner.

Also, it may be so configured that the first outdoor unit is provided with a plurality of the first outdoor heat exchangers and an opening/closing valve is disposed between at least one first outdoor heat exchanger and the first four-way valve. According to this configuration, since the number of the first outdoor heat exchangers used in the air-conditioning operation can be changed by controlling the operation of the opening/closing valve according to the load balance of the cooling load and the heating load during the cooling-heating mixed operation, the operation efficiency during the air-conditioning operation can be improved by changing the number of the first outdoor heat exchangers as appropriate.

Also, it may be so configured that a second outdoor unit having a second compressor and a second outdoor heat exchanger and connected by two pipelines of a gas pipe and a fluid pipe, is provided, the fluid pipe of the second outdoor unit is connected to the fluid pipe of the inter-unit pipeline, and the gas pipe of the second outdoor unit is selectively connected to the high-pressure gas pipe or the low-pressure gas pipe of the inter-unit pipeline using a valve-element kit having a channel switching valve.

According to this configuration, since the so-called double-pipeline type outdoor unit can be connected to the three inter-unit pipelines through the valve-element kit having the channel switching valve, a part of the outdoor units connected to the triple-pipeline type air conditioner can be constituted inexpensively using the existing double-pipeline type outdoor unit, whereby the price of the entire air conditioner can be reduced.

Also, it may be so configured that the valve-element kit is provided with a single second four-way valve as the channel switching valve, in which the gas pipe is connected to a first port of this second four-way valve, the low-pressure gas pipe is connected to a second port, the high-pressure gas pipe is connected to a third port, and a fourth port is closed or the low-pressure gas pipe is connected to this fourth port through a capillary tube.

According to this configuration, with the simple configuration that the second four-way valve is interposed, the gas pipe of the second outdoor unit can be selectively connected to the high-pressure gas pipe or the low-pressure gas pipe of the inter-unit pipeline, and the so-called double pipeline type outdoor unit can be connected to the triple-pipeline type air conditioner.

Also, the valve-element kit may be disposed outside a housing of the second outdoor unit. According to this configuration, since the existing double-pipeline type outdoor unit can be used as it is as the second outdoor unit without changing the pipeline configuration, the configuration of the triple-pipeline type air conditioner can be simplified.

DESCRIPTION OF EMBODIMENTS

<First Embodiment>

An embodiment of the present invention will be described referring to the attached drawings.

Figure 1:
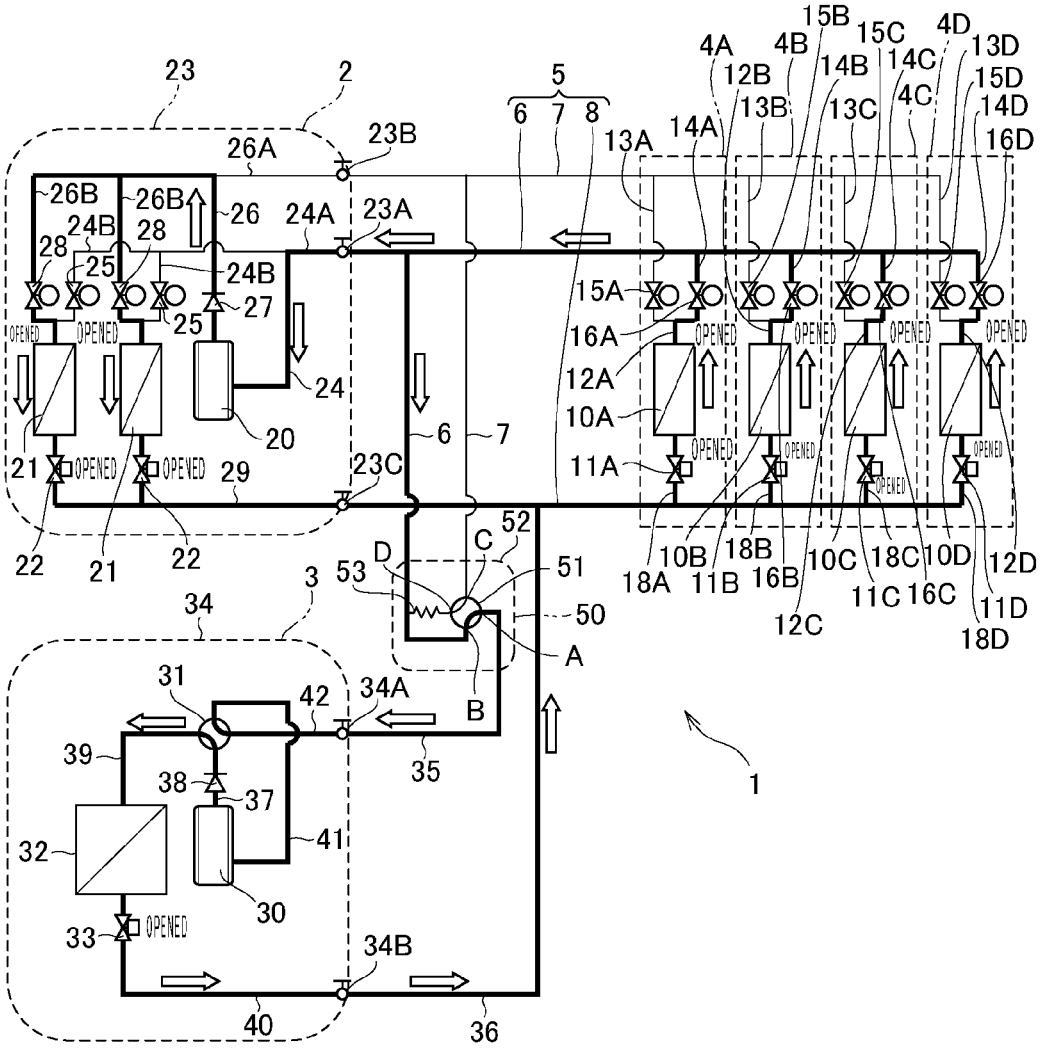
FIG. 1 shows an air conditioner according to a first embodiment of the present invention and is a circuit diagram illustrating a flow of a refrigerant when the air conditioner performs a cooling operation.

FIG. 1 is a circuit diagram illustrating an air conditioner according to a first embodiment. This air conditioner 1 includes a first outdoor unit 2, which is a triple-pipeline type outdoor unit, a second outdoor unit 3, which is a double-pipeline type outdoor unit, and a plurality of (four, for example) indoor units 4A, 4B, 4C, and 4D. An inter-unit pipeline 5 that connects the first outdoor unit 2 and the second outdoor unit 3 to the indoor units 4A to 4D is constituted by a low-pressure gas pipe 6, a high-pressure gas pipe 7, and a fluid pipe 8, and the air conditioner 1 is capable of performing a cooling operation or a heating operation of the indoor units 4A to 4D at the same time or a mixed operation of the cooling operation and the heating operation.

The indoor unit 4A includes an indoor heat exchanger 10A and an indoor expansion valve 11A, and one end of the indoor heat exchanger 10A is connected to the fluid pipe 8 through a fluid branch pipe 18A having the indoor expansion valve 11A disposed. Also, to the other end of the indoor heat exchanger 10A, a branch pipe 12A is connected, and the branch pipe 12A branches to a high-pressure gas branch pipe 13A and a low-pressure gas branch pipe 14A. The high-pressure gas branch pipe 13A is connected to the high-pressure gas pipe 7 through a first opening/closing valve 15A, while the low-pressure gas branch pipe 14A is connected to the low-pressure gas pipe 6 through a second opening/closing valve 16A.

Also, the indoor unit 4A is provided with temperature sensors (not shown) that detect inlet/outlet temperatures of the indoor heat exchanger 10A and a room temperature, a pressure sensor (not shown) that detects a refrigerant pressure in the indoor heat exchanger 10A and the like arranged and in addition, an indoor controller (not shown) that receives inputs of detection results of these sensors and executes control of the indoor unit 4A. Since the indoor units 4B to 4D have substantially the same configuration as that of the indoor unit 4A, the same reference numerals are given to the same portions and the description will be omitted.

The first outdoor unit 2 includes a variable-capacity type first compressor (DC inverter compressor) 20, a plurality of (two units in this embodiment) first outdoor heat exchangers 21 and 21 connected to the first compressor 20 in parallel, first expansion valves 22 and 22, and a first unit case (housing) 23 that contains them, and in this first unit case 23, a low-pressure gas pipe service valve 23A, a high-pressure gas pipe service valve 23B, and a first fluid-pipe service valve 23C to which a device in the first unit case 23 and the low-pressure gas pipe 6, the high-pressure gas pipe 7, and the fluid pipe 8 of the inter-unit pipeline 5 are connected, respectively, are disposed.

In this configuration, the capacity of the first compressor 20 is set at least at a half of the capacity of all the compressors provided in the air conditioner 1. According to this, if a cooling-heating mixed operation is performed with a load balance of a cooling load and a heating load of 50%:50%, for example, the cooling and heating operations of each of the indoor units 4A to 4D can be performed using only the first outdoor unit 2 provided with the first compressor 20. Also, if the cooling load or the heating load is increased and the load balance is changed to the cooling load and the heating load of 60%:40%, for example, the excess cooling load can be borne by the second outdoor unit 3. Thus, however changed the load balance of the cooling load and the heating load of the indoor units 4A to 4D during the cooling-heating mixed operation is, an air-conditioning operation with the load balance can be realized.

To an inlet of the first compressor 20, a refrigerant sucking pipe 24 is connected, and this refrigerant sucking pipe 24 is branched into two parts, one of which, that is, a refrigerant sucking branch pipe 24A is connected to the low-pressure gas pipe 6 through the low-pressure gas pipe service valve 23A. Also, the other refrigerant sucking branch pipe 24B is further branched to two parts, each of which is connected to the first outdoor heat exchanger 21 through a low-pressure side opening/closing valve (electromagnetic opening/closing valve) 25, respectively.

To an outlet of the first compressor 20, a refrigerant discharge pipe 26 is connected, and this refrigerant discharge pipe 26 is branched to two parts through a check valve 27. One refrigerant discharge branch pipe 26A is connected to the high-pressure gas pipe 7 through the high-pressure gas pipe service valve 23B, while the other refrigerant discharge branch pipe 26B is further branched into two parts, each of which is connected to the first outdoor heat exchanger 21 through a high-pressure side opening/closing valve (electromagnetic opening/closing valve) 28. The low-pressure side opening closing valve 25 and the high-pressure side opening/closing valve 28 are controlled such that one of them is selectively opened and functions as a switching valve that can switch one end of the first outdoor heat exchanger 21 so as to selectively communicate with either of the refrigerant sucking pipe 24 or the refrigerant discharge pipe 26 of the first compressor 20.

To the other end of the first outdoor heat exchanger 21, a first in-unit fluid pipe (fluid pipe) 29 is connected, and this first in-unit fluid pipe 29 is connected to the fluid pipe 8 through the first expansion valve 22 and the first fluid-pipe service valve 23C.

In the first outdoor unit 2, pressure sensors (not shown) that detect a sucking pressure and a discharge pressure of the first compressor 20 and a refrigerant pressure in each of the first outdoor heat exchangers 21 and 21, temperature sensors (not shown) that detect inlet/outlet temperatures of each of the first outdoor heat exchangers 21 and 21 and an outside temperature and the like are arranged and moreover, a first outdoor controller (not shown) that executes control of the first outdoor unit 2 by receiving inputs of detection results of these sensors is provided.

The second outdoor unit 3 includes a variable-capacity type second compressor (DC inverter compressor) 30, a four-way valve 31, a second outdoor heat exchanger 32, a second expansion valve 33, and a second unit case 34 that contains them, and in this second unit case 34, a gas-pipe service valve 34A and a second fluid-pipe service valve 34B to which a device in the second unit case 34 and two pipelines of a gas pipe 35 and a fluid pipe 36 are connected, respectively, are disposed. The second outdoor unit 3 is an existing double-pipeline type (two-way) outdoor unit capable of performing a cooling operation or a heating operation through switching of the four-way valve 31.

A refrigerant discharge pipe 37 of the second compressor 30 is connected to the four-way valve 31 through a check valve 38, and this four-way valve 31 is connected to one end of the second outdoor heat exchanger 32 through an in-unit gas pipe 39. To the other end of this second outdoor heat exchanger 32, a second in-unit fluid pipe 40 is connected, and this second in-unit fluid pipe 40 is connected to the second fluid-pipe service valve 34B through the second expansion valve 33. To the second fluid-pipe service valve 34B, the fluid pipe 36 is connected.

On the other hand, a refrigerant sucking pipe 41 of the second compressor 30 is connected to the four-way valve 31, and to this four-way valve 31, the gas-pipe service valve 34A is connected through an in-unit gas pipe 42. To this gas-pipe service valve 34A, the gas pipe 35 is connected.

Also, in the second outdoor unit 3, pressure sensors (not shown) that detect a sucking pressure and a discharge pressure of the second compressor 30 and a refrigerant pressure in the second outdoor heat exchanger 32, temperature sensors (not shown) that detect inlet/outlet temperatures of the second outdoor heat exchanger 32 and an outside temperature and the like are arranged and moreover, a second outdoor controller (not shown) that executes control of the second outdoor unit 3 by receiving inputs of detection results of these sensors is provided.

In this embodiment, the first outdoor unit 2 functions as a parent unit, and the first outdoor controller of this first outdoor unit 2 performs operation control of the entire air conditioner 1 by communicating with the second outdoor controller and each indoor controller on the basis of a user instruction inputted through a remote controller, not shown.

Since the second outdoor unit 3 is provided with two pipelines of the gas pipe 35 and the fluid pipe 36 extending from the second unit case 34, the two pipelines cannot be connected to the three inter-unit pipelines 5 as they are. Thus, in this configuration, the air conditioner 1 is provided with a valve-element kit 50 that selectively connects the gas pipe 35 extending from the second outdoor unit 3 to the high-pressure gas pipe 7 or the low-pressure gas pipe 6 of the inter-unit pipeline 5. This valve-element kit 50 includes a single four-way valve 51 as a channel switching valve and a case body 52 that contains the four-way valve 51, and in this case body 52, connection ports to which the above-mentioned gas pipe 35, the high-pressure gas pipe 7, and the low-pressure gas pipe 6 are connected, respectively, are formed. Also, the fluid pipe 36 extending from the second unit case 34 is connected to the fluid pipe 8 of the inter-unit pipeline 5.

The valve-element kit 50 is an exclusive kit that connects the second outdoor unit 3, which is an existing double-pipeline type outdoor unit, to the inter-unit pipeline 5, and one unit of the valve-element kit 50 is disposed for one unit of the second outdoor unit 3. According to this, by using the valve-element kit 50, the existing double-pipeline type second outdoor unit 3 can be connected to the inter-unit pipeline 5, and for a part of the outdoor units connected to the triple-pipeline type air conditioner 1, an inexpensive existing double-pipeline type outdoor unit can be employed instead of an expensive triple-pipeline type outdoor unit with a complicated piping configuration, whereby the price of the entire air conditioner 1 can be lowered.

Also, the valve-element kit 50 is arranged outside the second unit case 34 of the second outdoor unit 3. According to this, the existing double-pipeline type second outdoor unit 3 can be used for the triple-pipeline type air conditioner 1 as it is without changing the piping configuration, and the configuration of the air conditioner 1 can be simplified.

On the four-way valve 51 of the valve-element kit 50, four ports A to D are disposed, in which the gas pipe 35 is connected to a first port A, the low-pressure gas pipe 6 is connected to a second port B, the high-pressure gas pipe 7 is connected to a third port C, and a capillary tube 53 is connected to a fourth port D, and the other end of this capillary tube 53 is connected to the low-pressure gas pipe 6.

In this embodiment, if the second outdoor unit 3 is stopped, a flow of the refrigerant in the refrigerant pipeline (the high-pressure gas pipe 7, the low-pressure gas pipe 6 of the inter-unit pipeline 5 and the gas pipe 35) connected to this second outdoor unit 3 might be stopped. Thus, in order to prevent collection of the refrigerant into the refrigerant pipeline, the low-pressure gas pipe 6 is connected to the fourth port D through the capillary tube 53. The fourth port D may be simply closed by a sealing plug or the like without connecting the low-pressure gas pipe 6 to the fourth port D through the capillary tube 53.

The four-way valve 51 of the valve-element kit 50 has the operation thereof controlled by the second outdoor controller of the second outdoor unit 3.

Subsequently, an operation of this air conditioner 1 will be described.

If all the indoor units 4A to 4D are to perform the cooling operation at the same time, the high-pressure gas pipe 7 is brought into a sleep state. In this case, as shown in FIG. 1, in the first outdoor unit 2, the high-pressure side opening/closing valve 28 is opened, while the low-pressure side opening/closing valve 25 is closed, and in the second outdoor unit 3, the four-way valve 31 is switched to a position of the cooling operation where the discharged refrigerant of the second compressor 30 is led to the second outdoor heat exchanger 32. Also, in all the indoor units 4A to 4D, the first opening/closing valves 15A to 15D are closed, while the second opening/closing valves 16A to 16D are opened. Also, in the valve-element kit 50, the four-way valve 51 is switched to the first switching position where the first port A and the second port B as well as the third port C and the fourth port D communicate with each other.

As a result, the refrigerant discharged from the first compressor 20 sequentially flows into the refrigerant discharge pipe 26, the other refrigerant discharge branch pipe 26B, the high-pressure side opening/closing valve 28, and the first outdoor heat exchanger 21, is condensed and liquefied in this first outdoor heat exchanger 21 and then, flows into the fluid pipe 8 of the inter-unit pipeline 5 through the first in-unit fluid pipe 29. On the other hand, the refrigerant discharged from the second compressor 30 sequentially flows into the refrigerant discharge pipe 37, the four-way valve 31, and the second outdoor heat exchanger 32, is condensed and liquefied in this second outdoor heat exchanger 32 and then, flows into the fluid pipe 8 of the inter-unit pipeline 5 through the fluid pipe 36 and merges with the refrigerant flowing out of the first outdoor unit 2 in this fluid pipe 8.

The liquid refrigerant flowing through the fluid pipe 8 is distributed to the indoor expansion valves 11A to 11D of the indoor units 4A to 4D and is decompressed therein. Then, the decompressed refrigerant is evaporated and vaporized in the indoor heat exchangers 10A to 10D and then, flows into the low-pressure gas pipe 6 through the second opening/closing valves 16A to 16D and the low-pressure gas branch pipes 14A to 14D, respectively, and is distributed to two parts in this low-pressure gas pipe 6.

One of the refrigerants flows into the first outdoor unit 2 and is sucked into the first compressor 20 through the refrigerant sucking pipe 24. The other refrigerant flows into the second outdoor unit 3 through the four-way valve 51 of the valve-element kit 50 and the gas pipe 35 and is sucked into the second compressor 30 through the four-way valve 31 and the refrigerant sucking pipe 41. As mentioned above, all the indoor units 4A to 4D are cooled at the same time by the indoor heat exchangers 10A to 10D working as evaporators.

Figure 2:
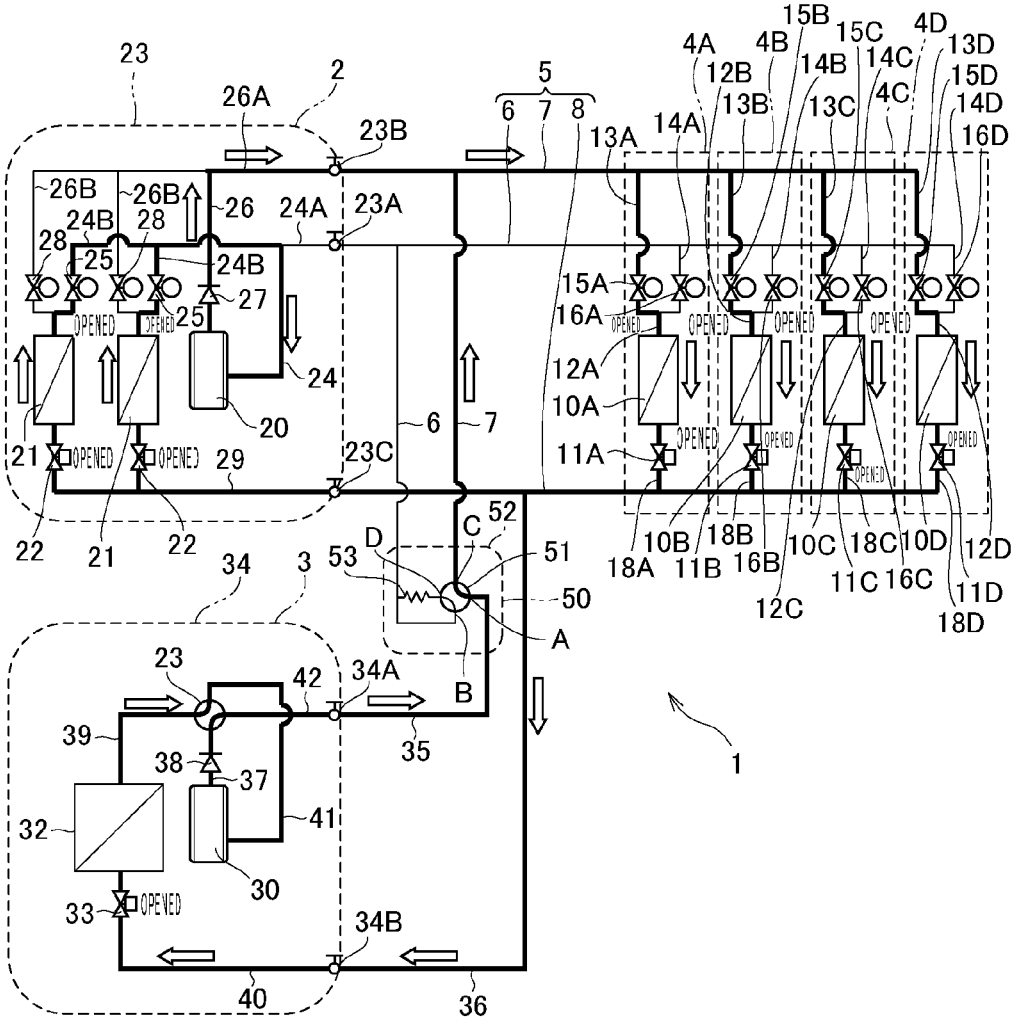
FIG. 2 is a circuit diagram illustrating the flow of the refrigerant when the air conditioner performs a heating operation.

If all the indoor units 4A to 4D perform the heating operation at the same time, the low-pressure gas pipe 6 is brought into the sleep state. In this case, as shown in FIG. 2, in the first outdoor unit 2, the high-pressure side opening/closing valve 28 is closed, while the low-pressure side opening/closing valve 25 is opened, and in the second outdoor unit 3, the four-way valve 31 is switched to a position of the heating operation where the discharged refrigerant of the second compressor 30 is led to the gas pipe 35. Also, in all the indoor units 4A to 4D, the first opening/closing valves 15A to 15D are opened, while the second opening/closing valves 16A to 16D are closed. Also, in the valve-element kit 50, the four-way valve 51 is switched to the second switching position where the first port A and the third port C as well as the second port B and the fourth port D communicate with each other.

As a result, the refrigerant discharged from the first compressor 20 flows into the high-pressure gas pipe 7 of the inter-unit pipeline 5 through the refrigerant discharge pipe 26 and the one refrigerant discharge branch pipe 26A. On the other hand, the refrigerant discharged from the second compressor 30 flows into the high-pressure gas pipe 7 of the inter-unit pipeline 5 through the refrigerant discharge pipe 37, the four-way valve 31, the in-unit gas pipe 42, the gas pipe 35, and the four-way valve 51 of the valve-element kit 50 and merges with the refrigerant flowing out of the first outdoor unit 2 in this high-pressure gas pipe 7.

The gas refrigerant flowing through the high-pressure gas pipe 7 is distributed to the high-pressure gas branch pipes 13A to 13D of the indoor units 4A to 4D and then, flows into the first opening/closing valves 15A to 15D and the indoor heat exchangers 10A to 10D and is condensed and liquefied, respectively, therein. The liquefied liquid refrigerant flows into the fluid pipe 8 through the fluid branch pipes 18A to 18D and is distributed to two parts in this fluid pipe 8.

One of the refrigerants flows into the first outdoor unit 2, is distributed to each of the first expansion valves 22 and 22 and is decompressed therein. Then, the decompressed refrigerant is evaporated and vaporized in each of the first outdoor heat exchangers 21 and 21 and then, is sucked into the first compressor 20 through the low-pressure side opening/closing valves 25 and 25 and the refrigerant sucking pipe 24. Also, the other refrigerant flows into the second outdoor unit 3 through the fluid pipe 36 and is decompressed by the second expansion valve 33. Then, the decompressed refrigerant is evaporated and vaporized in the second outdoor heat exchanger 32 and then, is sucked into the second compressor 30 through the four-way valve 31 and the refrigerant sucking pipe 41. As mentioned above, all the indoor units 4A to 4D are heated at the same time by the indoor heat exchangers 10A to 10D working as condensers.

In the case of the cooling-heating mixed operation with an emphasis on the cooling by the indoor units 4A to 4D, if the indoor units 4A to 4C are used for the cooling operation and the indoor unit 4D is used for the heating operation, for example, the low-pressure gas pipe 6, the high-pressure gas pipe 7, and the fluid pipe 8 are all used.

Figure 3:
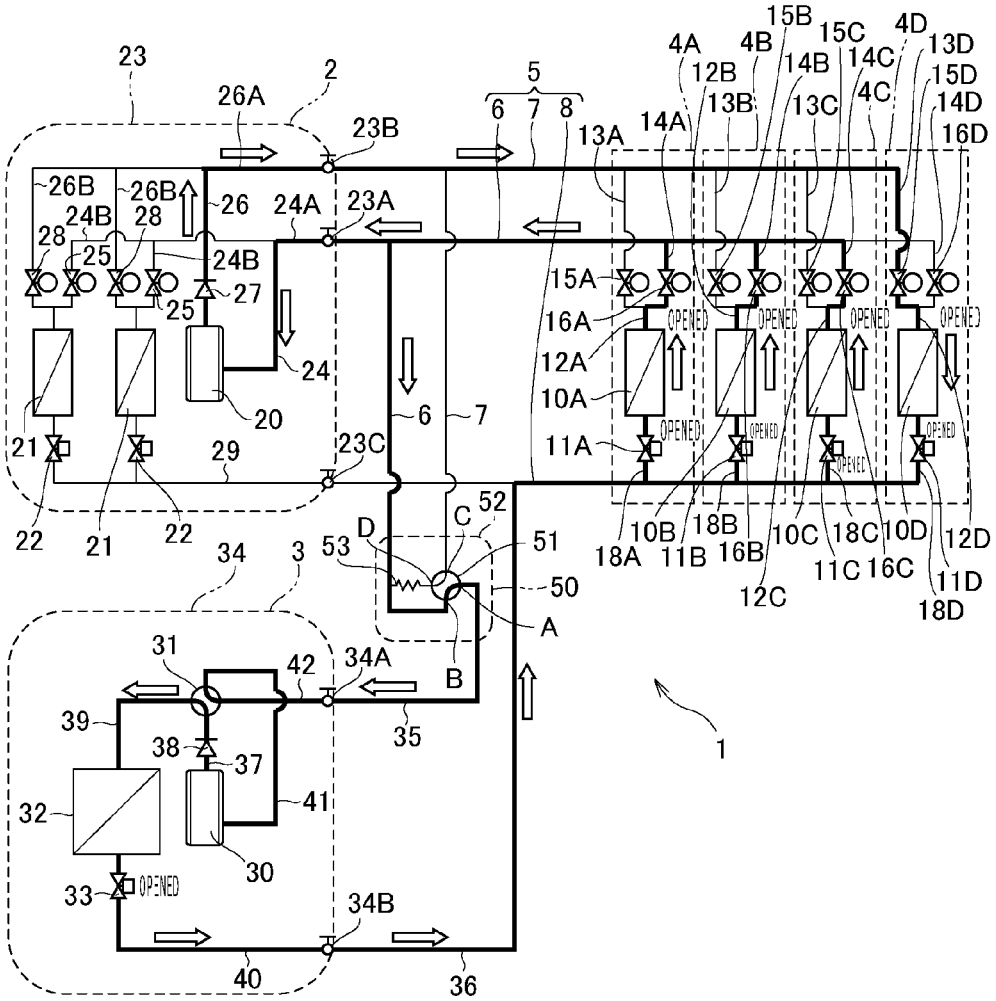
FIG. 3 is a circuit diagram illustrating the flow of the refrigerant when the air conditioner performs a mixed operation of cooling and heating with an emphasis on the cooling.

In this case, as shown in FIG. 3, in the first outdoor unit 2, both the high-pressure side opening/closing valve 28 and the low-pressure side opening/closing valve 25 are closed, and the refrigerant does not flow into the first outdoor heat exchangers 21 and 21. That is because cooling loads in the indoor units 4A to 4C balanced with a heating load in the indoor unit 4D is borne by the first outdoor unit 2, while the excess cooling load is borne by the second outdoor unit 3, whereby a refrigerating cycle is formed.

Also, in the second outdoor unit 3, the four-way valve 31 is switched to the position of the cooling operation where the discharged refrigerant of the second compressor 30 is led to the second outdoor heat exchanger 32. Also, in the indoor units 4A to 4C, the first opening/closing valves 15A to 15C are closed, the second opening/closing valves 16A to 16C are opened, and in the indoor unit 4D, the first opening/closing valve 15D is opened, and the second opening/closing valve 16D is closed. Also, in the valve-element kit 50, the four-way valve 51 is switched to the first switching position where the first port A and the second port B as well as the third port C and the fourth port D communicate with each other.

As a result, the refrigerant discharged from the first compressor 20 flows into the indoor unit 4D through the refrigerant discharge pipe 26, the one refrigerant discharge branch pipe 26A, and the high-pressure gas pipe 7. The refrigerant having flown into the indoor unit 4D flows into the indoor heat exchanger 10D through the high-pressure gas branch pipe 13D and the first opening/closing valve 15D, is condensed and liquefied therein and then, flows into the fluid pipe 8 through the fluid branch pipe 18D.

On the other hand, the refrigerant discharged from the second compressor 30 sequentially flows into the refrigerant discharge pipe 37, the four-way valve 31, and the second outdoor heat exchanger 32, is condensed and liquefied in this second outdoor heat exchanger 32 and then, flows into the fluid pipe 8 of the inter-unit pipeline 5 through the fluid pipe 36 and merges with the refrigerant flowing out of the first outdoor unit 2 in this fluid pipe 8.

The liquid refrigerant flowing through the fluid pipe 8 is distributed to the indoor expansion valves 11A to 11C of the indoor units 4A to 4C and decompressed therein. Then, the decompressed refrigerant is evaporated and vaporized in each of the indoor heat exchangers 10A to 10C and then, flows into the low-pressure gas pipe 6 through the second opening/closing valves 16A to 16C, the low-pressure gas branch pipes 14A to 14C, respectively, and is distributed into two parts in this low-pressure gas pipe 6.

One of the refrigerants flows in to the first outdoor unit 2 and is sucked into the first compressor 20 through the refrigerant sucking pipe 24. Also, the other refrigerant flows into the second outdoor unit 3 through the four-way valve 51 of the valve-element kit 50 and the gas pipe 35 and is sucked into the second compressor 30 through the four-way valve 31 and the refrigerant sucking pipe 41. As mentioned above, the indoor units 4A to 4C are cooled by the indoor heat exchangers 10A to 10C working as evaporators, while the indoor unit 4D is heated by the other indoor heat exchanger 10D working as a condenser.

In this configuration, the second outdoor unit 3 is connected to the inter-unit pipeline 5 through the valve-element kit 50, and the refrigerant condensed by the second outdoor heat exchanger 32 of the second outdoor unit 3 merges with the refrigerant condensed in the indoor heat exchanger 10D in the fluid pipe 8. Thus, in the case of the cooling-heating mixed operation, since condensing pressures (condensing temperatures) can be set independently for the indoor heat exchanger 10D and the second outdoor heat exchanger 32 working as condensers, if the outdoor temperature is low as in the winter, for example, the condensing pressure of the second outdoor heat exchanger 32 can be suppressed lower than the condensing pressure of the indoor heat exchanger 10D, whereby the workload (power consumption) of the second compressor 30 can be reduced.

Figure 4:
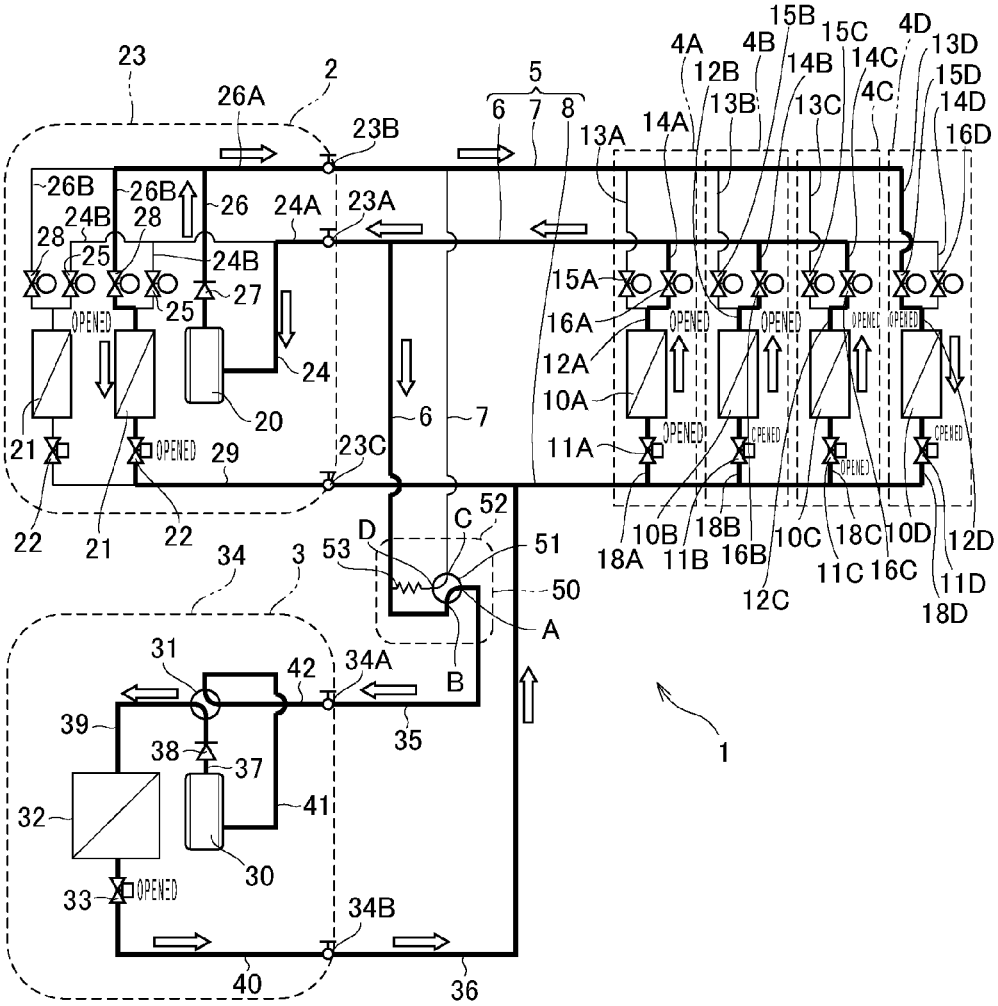
FIG. 4 is a circuit diagram illustrating a flow of the refrigerant when a first outdoor heat exchanger is used as a condenser in FIG. 3.

Also, if cooling loads of the indoor units 4A to 4C are increased and cannot be handled by the second outdoor heat exchanger 32 of the second outdoor unit 3, as shown in FIG. 4, the one high-pressure side opening/closing valve 28 of the first outdoor unit 2 is opened so as to lead a part of the refrigerant discharged from the first compressor 20 to the first outdoor heat exchanger 21, whereby the first outdoor heat exchanger 21 can be made to work as a condenser.

In this configuration, since the first outdoor unit 2 is provided with the two first outdoor heat exchangers 21 and 21 provided in parallel and the refrigerant can be distributed to each of the first outdoor heat exchangers 21 and 21 to flow, the number of the first outdoor heat exchangers 21 and 21 used in the air-conditioning operation can be changed by controlling the operation of the high-pressure side opening/closing valve 28 and the low-pressure side opening/closing valve 25 according to the load balance of the cooling load and the heating load during the cooling-heating mixed operation, the operation efficiency during the air-conditioning operation can be improved.

In the case of the cooling-heating mixed operation with an emphasis on the heating of the indoor units 4A to 4D, if the indoor unit 4A performs the cooling operation and the indoor units 4B to 4D perform the heating operation, the low-pressure gas pipe 6, the high-pressure gas pipe 7, and the fluid pipe 8 are all used.

Figure 5:
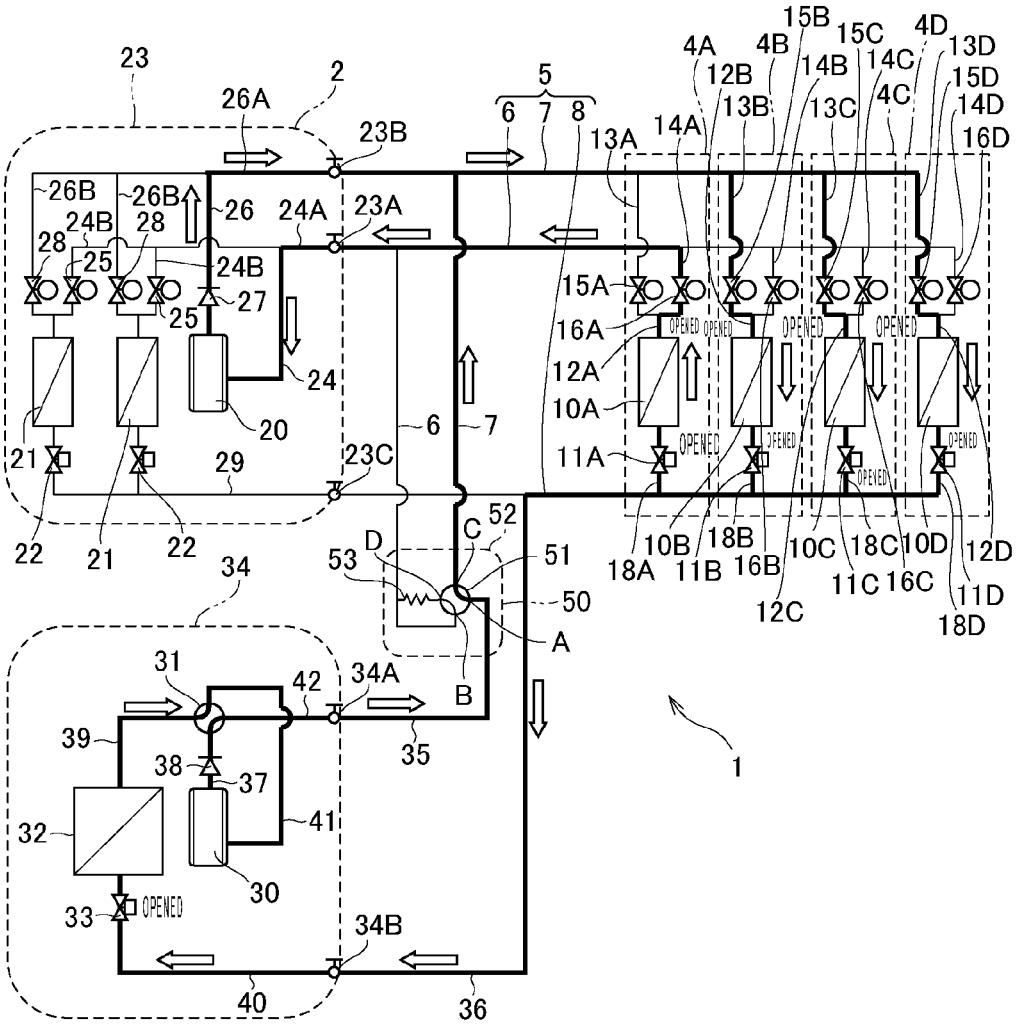
FIG. 5 is a circuit diagram illustrating the flow of the refrigerant when the air conditioner performs a mixed operation of cooling and heating with an emphasis on the heating.

In this case, as shown in FIG. 5, in the first outdoor unit 2, the high-pressure side opening/closing valve 28 and the low-pressure side opening/closing valve 25 are both closed, and the refrigerant does not flow into the first outdoor heat exchangers 21 and 21.

Also, in the second outdoor unit 3, the four-way valve 31 is switched to the position of the heating operation where the discharge refrigerant of the second compressor 30 is led to the gas pipe 35. Also, in the indoor unit 4A, the first opening/closing valve 15A is closed and the second opening/closing valve 16A is opened, and in the indoor units 4B to 4D, the first opening/closing valves 15B to 15D are opened, and the second opening/closing valves 16B to 16D are closed. Also, in the valve-element kit 50, the four-way valve 51 is switched to the second switching position where the first port A and the third port C as well as the second port B and the fourth port D communicate with each other.

As a result, the refrigerant discharged from the first compressor 20 flows into the high-pressure gas pipe 7 of the inter-unit pipeline 5 through the refrigerant discharge pipe 26 and the one refrigerant discharge branch pipe 26A. On the other hand, the refrigerant discharged from the second compressor 30 flows into the high-pressure gas pipe 7 of the inter-unit pipeline 5 through the refrigerant discharge pipe 37, the four-way valve 31, the in-unit gas pipe 42, the gas pipe 35, and the four-way valve 51 of the valve-element kit 50 and merges with the refrigerant flowing out of the first outdoor unit 2 in this high-pressure gas pipe 7.

The gas refrigerant flowing through the high-pressure gas pipe 7 is distributed to the high-pressure gas branch pipes 13B to 13D of the indoor units 4B to 4D and then, flows into the first opening/closing valves 15B to 15D and the indoor heat exchangers 10B to 10D and is condensed and liquefied therein. The liquefied liquid refrigerant flows into the fluid pipe 8 through the fluid branch pipes 18B to 18D.

A part of the liquid refrigerant having flown into this fluid pipe 8 flows into the indoor unit 4A, is decompressed by the indoor expansion valve 11A of the indoor unit 4A and the decompressed refrigerant is evaporated and vaporized in the indoor heat exchanger 10A. Then, this vaporized gas refrigerant flows into the first outdoor unit 2 through the second opening/closing valve 16A, the low-pressure gas branch pipe 14A, and the low-pressure gas pipe 6 and is sucked into the first compressor 20 through the refrigerant sucking pipe 24.

On the other hand, the remaining liquid refrigerant having flown into the liquid pipe 8 flows into the second outdoor unit 3 through the fluid pipe 36 and is decompressed by the second expansion valve 33. Then, the decompressed refrigerant is evaporated and vaporized in the second outdoor heat exchanger 32 and then, is sucked into the second compressor 30 through the four-way valve 31 and the refrigerant sucking pipe 41. As mentioned above, the indoor unit 4A is cooled by the indoor heat exchanger 10A working as an evaporator, while the indoor units 4B to 4D are heated by the other indoor heat exchangers 10B to 10D working as condensers, respectively.

In this configuration, since the second outdoor unit 3 is connected to the inter-unit pipeline 5 through the valve-element kit 50, a part of the refrigerant condensed in each of the indoor heat exchangers 10B to 10D of each of the indoor units 4B to 4D can be led to the indoor heat exchanger 10A of the indoor unit 4A, while the remaining refrigerant can be led to the second outdoor heat exchanger 32 of the second outdoor unit 3. Thus, in the case of the cooling-heating mixed operation, evaporation pressures (evaporation temperatures) of the indoor heat exchanger 10A and the second outdoor heat exchanger 32 working as evaporators can be set independently. Thus, if the outside temperature is low as in the winter, for example, the evaporation temperature of the indoor heat exchanger 10D can be set at an appropriate temperature higher than the evaporation temperature of the second outdoor heat exchanger 32 as compared with the evaporation temperature of the second outdoor heat exchanger 32, which is lowered with this outdoor temperature. As a result, since drop of the evaporation temperature of the indoor heat exchanger 10D due to an influence of the outdoor temperature as before is prevented, means that prevents freezing of the indoor heat exchanger 10D is no longer required.

Figure 6:
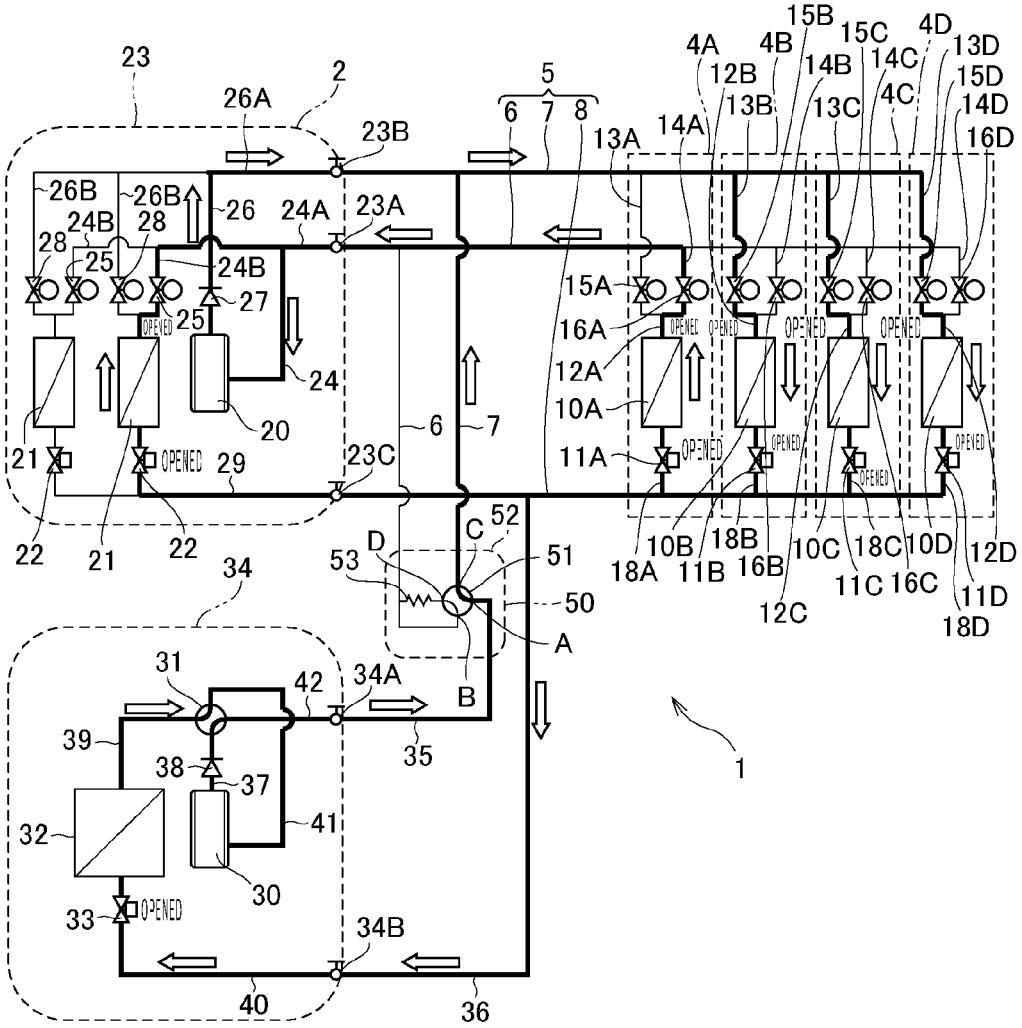
FIG. 6 is a circuit diagram illustrating a flow of the refrigerant when the first outdoor heat exchanger is used as an evaporator in FIG. 5.

Also, if the heating loads of the indoor units 4B to 4D are increased and cannot be borne by the second outdoor heat exchanger 32 of the second outdoor unit 3, as shown in FIG. 6, the low-pressure side opening/closing valve 25 of the first outdoor unit 2 is opened so as to lead apart of the refrigerant flowing through the fluid pipe 8 to the first outdoor heat exchanger 21, whereby the first outdoor heat exchanger 21 can be made to work as an evaporator.

In this configuration, since the first outdoor unit 2 is provided with the two first outdoor heat exchangers 21 and 21 provided in parallel and the refrigerant can be distributed to each of the first outdoor heat exchangers 21 and 21 to flow, the number of the first outdoor heat exchangers 21 and 21 used in the air-conditioning operation can be changed by controlling the operation of the high-pressure side opening/closing valve 28 and the low-pressure side opening/closing valve 25 according to the load balance of the cooling load and the heating load during the cooling-heating mixed operation, and the operation efficiency during the air-conditioning operation can be improved.

As mentioned above, according to this embodiment, in the air conditioner 1 constituted by the triple-pipeline type first outdoor unit 2 provided with the first compressor 20, the first outdoor heat exchanger 21, and the first expansion valve 22 and connected to the three inter-unit pipelines 5 made up of the high-pressure gas pipe 7, the low-pressure gas pipe 6, and the fluid pipe 8 and by the plurality of indoor units 4A to 4D provided with the indoor heat exchangers 10A to 10D and configured so that the indoor units 4A to 4D can perform the cooling operation or the heating operation at the same time or the cooling operation and the heating operation can be performed in a mixed manner, the second outdoor unit 3 provided with the second compressor 30, the second outdoor heat exchanger 32, and the second expansion valve 33 and connected by two pipelines of the gas pipe 35 and the fluid pipe 36 is provided, and the fluid pipe 38 of the second outdoor unit 3 is connected to the fluid pipe 8 of the inter-unit pipeline 5 and also, the gas pipe 35 of the second outdoor unit 3 is selectively connected to the high-pressure gas pipe 7 or the low-pressure gas pipe 6 of the inter-unit pipeline 5 using the valve-element kit 50 having the four-way valve 51, and the so-called double-pipeline type second outdoor unit 3 can be connected to the three inter-unit pipelines 5, and a part of the outdoor units connected to these three inter-unit pipelines 5 can be constituted inexpensively using the existing double-pipeline type second outdoor unit 3, whereby the price of the entire air conditioner 1 can be reduced.

Also, according to this embodiment, the valve-element kit 50 is provided with the single four-way valve 51, the gas pipe 35 is connected to the first port A of this four-way valve 51, the low-pressure gas pipe 6 is connected to the second port B, the high-pressure gas pipe 7 is connected to the third port C, and the low-pressure gas pipe 6 is connected to the fourth-port D through the capillary tube 53, and thus, with the simple configuration in which the four-way valve 51 is interposed, the gas pipe 35 of the second outdoor unit 3 can be selectively connected to the high-pressure gas pipe 7 or the low-pressure gas pipe 6 of the inter-unit pipeline 5, and the so-called double-pipeline type outdoor unit 3 can be connected to the triple-pipeline type air conditioner 1.

Also, according to this embodiment, since the valve-element kit 50 is disposed outside the second unit case 34 of the second outdoor unit 3, the existing double-pipeline type outdoor unit can be used as the second outdoor unit 3 as it is without changing the pipeline configuration thereof, and the configuration of the triple-pipeline type air conditioner 1 can be simplified.

Also, according to this embodiment, since the capacity of the first compressor 20 is constituted with the capacity of at least a half of all the compressors provided in the air conditioner 1, in the case of the load balance of the cooling load and the heating load of the cooling-heating mixed operation at 50%:50%, the air-conditioning operation can be performed using the first outdoor unit 2 provided with the first compressor 20, and if the cooling load or the heating load is increased and the load balance is changed, the excess load of the cooling load or the heating load can be borne by the second outdoor unit 3. Thus, however changed the load balance of the cooling load and the heating load during the cooling-heating mixed operation is, the air-conditioning operation with the load balance can be realized.

Also, according to this embodiment, the first outdoor unit 2 is provided with a plurality of first outdoor heat exchangers 21 in parallel, in which one ends of the first outdoor heat exchangers 21 and 21 are connected to the refrigerant discharge pipe 26 and the refrigerant sucking pipe 24 through the refrigerant discharge pipe branch pipe 26B and the refrigerant sucking pipe branch pipe 24B, respectively, and the high-pressure side opening/closing valve 28 and the low-pressure side opening/closing valve 25 are disposed in the refrigerant discharge pipe branch pipe 26B and the refrigerant sucking pipe branch pipe 24B, respectively, and thus, the number of the first outdoor heat exchangers 21 and 21 used in the air-conditioning operation can be changed by controlling the operation of the high-pressure side opening/closing valve 28 and the low-pressure side opening/closing valve 25 according to the load balance of the cooling load and the heating load during the cooling-heating mixed operation, whereby the operation efficiency during the air-conditioning operation can be improved by changing the number of the first outdoor heat exchangers 21 and 21 as appropriate.

Also, since the one ends of the indoor heat exchangers 10A to 10D are connected to the high-pressure gas pipe 7 and the low-pressure gas pipe 6 through the high-pressure gas branch pipes 13A to 13D and the low-pressure gas branch pipes 14A to 14D, respectively, and the first opening/closing valve 15A and the second opening/closing valve 16A are disposed in the high-pressure gas branch pipes 13A to 13D and the low-pressure gas branch pipes 14A to 14D, respectively, the indoor heat exchangers 10A to 10D can be made to function as evaporators or condensers at the same time by opening/closing controlling the first opening/closing valve 15A and the second opening/closing valve 16A, and the cooling-heating mixed operation of the indoor units 4A to 4D can be realized easily.

The present invention has been described above on the basis of the above embodiment, but the present invention is not limited to that. The valve-element kit 50 is configured to be provided with the four-way valve 51 as a channel switching valve, but not limited to that, a plurality of electromagnetic opening/closing valves may be combined.

<Second Embodiment>

A second embodiment will be described below referring to the attached drawings.

Figure 7:
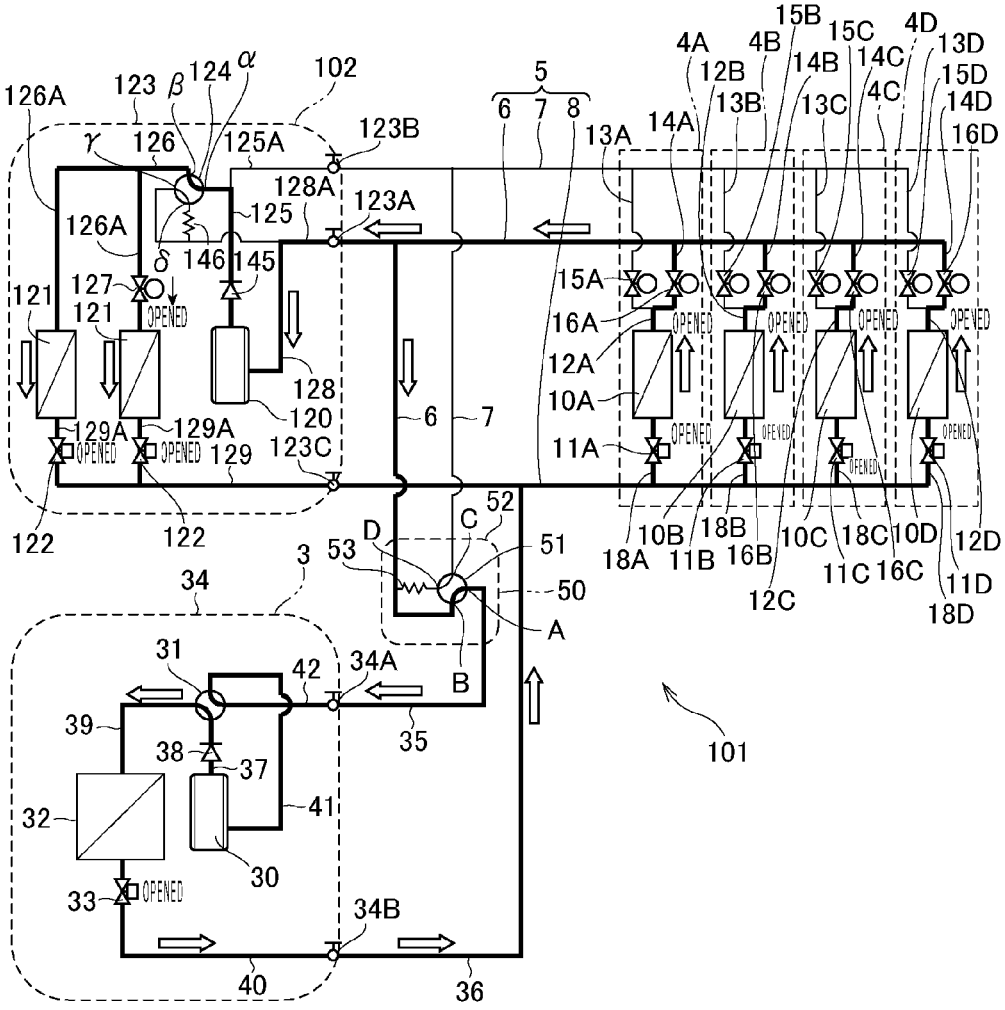
FIG. 7 shows an air conditioner according to a second embodiment and is a circuit diagram illustrating a flow of a refrigerant when the air conditioner performs a cooling operation.

FIG. 7 is a circuit diagram illustrating an air conditioner according to the second embodiment. An air conditioner 101 according to this second embodiment is provided with a first outdoor unit 102, which is a triple-pipeline type outdoor unit, the second outdoor unit 3, which is the double-pipeline type outdoor unit, a plurality of (four units, for example) indoor units 4A, 4B, 4C, and 4D, and the valve-element kit 50, and the indoor units 4A to 4D are made capable of performing the cooling operation or the heating operation at the same time or the cooling operation and the heating operation can be performed in a mixed manner. Here, the air conditioner 101 has a configuration of the first outdoor unit 102 different from that of the air conditioner 1 according to the above first embodiment. Thus, the same reference numerals are given to the same configurations as those in the air conditioner 1 and the description will be omitted.

The first outdoor unit 102 includes a variable-capacity type first compressor (DC inverter compressor) 120, a first four-way valve 124, a plurality of (two units in this embodiment) first outdoor heat exchangers 121 and 121 connected in parallel with the first four-way valve 124, the first expansion valves 122 and 122, and a first unit case (housing) 123 that contains them. In this first unit case 123, a low-pressure gas pipe service valve 123A, a high-pressure gas pipe service valve 123B, and a first fluid-pipe service valve 123C to which each device in the first unit case 123 and the low-pressure gas pipe 6, the high-pressure gas pipe 7, and the fluid pipe 8 of the inter-unit pipeline 5 are connected, respectively, are disposed.

In this configuration, the capacity of the first compressor 120 is set at least at a half of the capacity of all the compressors provided in the air conditioner 101. According to this, if a cooling-heating mixed operation is performed with a load balance of a cooling load and a heating load of 50%:50%, for example, the cooling and heating operations of each of the indoor units 4A to 4D can be performed using only the first outdoor unit 102 provided with the first compressor 120. Also, if the cooling load or the heating load is increased and the load balance is changed to the cooling load and the heating load of 60%:40%, for example, the excess cooling load can be borne by the second outdoor unit 3. Thus, however changed the load balance of the cooling load and the heating load of the indoor units 4A to 4D during the cooling-heating mixed operation is, an air-conditioning operation with the load balance can be realized.

The first four-way valve 124 is provided with four ports, in which a refrigerant discharge pipe 125 of the first compressor 120 is connected to a first port α. To this refrigerant discharge pipe 125, one end of a refrigerant discharge branch pipe 125A branching between the first compressor 120 and the first four-way valve 124 is connected, while the other end of this refrigerant discharge branch pipe 125A is connected to the high-pressure gas pipe 7 through the high-pressure gas pipe service valve 123B. Reference numeral 145 denotes a check valve.

Also, to a second port β of the first four-way valve 124, an in-unit gas pipe 126 is connected, and this in-unit gas pipe 126 branches into two in-unit branch gas pipes 126A and 126A, each of which is connected to one end sides of the first outdoor heat exchangers 121 and 121, respectively. In this configuration, in the in-unit branch gas pipe 126A connected to the one first outdoor heat exchanger 121, an electromagnetic opening/closing valve (opening/closing valve) 127 is disposed and configured such that the refrigerant can be selectively made to communicate through the first outdoor heat exchangers 121 and 121.

To the other ends of the first outdoor heat exchangers 121 and 121, in-unit branch fluid pipes 129A and 129A are connected, respectively, and the in-unit branch fluid pipes 129A and 129A merge together so as to forma first in-unit fluid pipe (fluid pipe) 129 and it is connected to the fluid pipe 8 of the inter-unit pipeline 5 through the first fluid-pipe service valve 123C. Also, in the in-unit branch fluid pipes 129A and 129A, the above-mentioned first expansion valves 122 and 122 are disposed, respectively.

Also, to a third port γ of the first four-way valve 124, a refrigerant sucking pipe 128 of the first compressor 120 is connected, and to this refrigerant sucking pipe 128, one end of a refrigerant sucking branch pipe 128A branching between the first compressor 120 and the first four-way valve 124 is connected, while the other end of the refrigerant sucking branch pipe 128A is connected to the low-pressure gas pipe 6 through the low-pressure gas pipe service valve 123A.

Also, to a fourth port δ of the first four-way valve 124, a capillary tube 146 is connected, and the other end of this capillary tube 146 is connected to the refrigerant sucking pipe 128. In this embodiment, if the first outdoor unit 102 is stopped, a flow of a refrigerant in the refrigerant pipeline (the refrigerant discharge pipe 125 and the refrigerant sucking pipe 128) in the first outdoor unit 102 might be stopped. Thus, in order to prevent collection of the refrigerant into the refrigerant pipeline, the refrigerant sucking pipe 128 is connected to the fourth port δ through the capillary tube 146. The fourth port δ may be simply closed by a sealing plug or the like without connecting the refrigerant sucking pipe 128 to the fourth port δ through the capillary tube 146.

In this configuration, the first outdoor unit 102 is made capable of being connected to the three inter-unit pipelines 5 by changing the piping configuration of the so-called double-pipeline type outdoor unit.

Specifically, the high-pressure gas pipe service valve 123B is disposed in the first unit case 123, and the high-pressure gas pipe service valve 123B and the refrigerant discharge pipe 125 are connected by the refrigerant discharge branch pipe 125A. Also, in the double-pipeline type outdoor unit, a pipeline that connects the gas-pipe service valve (corresponding to the low-pressure gas pipe service valve 123A in this configuration) and the four-way valve (corresponding to the fourth port δ of the first four-way valve 124 in this configuration) is removed, the low-pressure gas pipe service valve 123A and the refrigerant sucking pipe 128 are connected by the refrigerant sucking branch pipe 128A and the fourth port δ of the first four-way valve 124 is connected to the refrigerant sucking pipe 28 through the capillary tube 146.

As mentioned above, since the first outdoor unit 102 that can be connected to the three inter-unit pipelines 5 can be easily constituted by partially changing the piping configuration of the existing double-pipeline type outdoor unit, as compared with a case in which the triple-pipeline type outdoor unit is developed independently, a development period can be reduced and a manufacturing line can be made common, whereby a production cost can be reduced. Also, since the first outdoor unit 102 is constituted on the basis of the so-called double-pipeline type outdoor unit, this first outdoor unit 102 has the piping configuration thereof more simplified than the prior-art triple-pipeline type outdoor unit, by which size reduction of the device can be realized.

Also, in the first outdoor unit 102, pressure sensors (not shown) that detect a sucking pressure and a discharge pressure of the first compressor 120 and a refrigerant pressure in each of the first outdoor heat exchangers 121 and 121, temperature sensors (not shown) that detect inlet/outlet temperatures of each of the first outdoor heat exchangers 121 and 121 and an outside temperature and the like are arranged and moreover, a first outdoor controller (not shown) that executes control of the first outdoor unit 102 by receiving inputs of detection results of these sensors is provided.

Subsequently, the operation of this air conditioner 101 will be described.

If all the indoor units 4A to 4D are made to perform the cooling operation at the same time, the high-pressure gas pipe 7 is brought into the sleep state. In this case, as shown in FIG. 7, in the first outdoor unit 102, the first four-way valve 124 is switched to a position (second switching position) where the discharged refrigerant of the first compressor 120 is led to the first outdoor heat exchangers 121 and 121, that is, the position where the first port α and the second port β as well as the third port γ and the fourth port δ of the first four-way valve 124 communicate with each other, and the electromagnetic opening/closing valve 127 and the first expansion valves 122 and 122 are opened. Also, in the second outdoor unit 3, the four-way valve 31 is switched to the position of the cooling operation where the discharged refrigerant of the second compressor 30 is led to the second outdoor heat exchanger 32. Also, in all the indoor units 4A to 4D, the first opening/closing valves 15A to 15D are closed, while the second opening/closing valves 16A to 16D are opened. Also, in the valve-element kit 50, the second four-way valve 51 is switched to the position where the first port A and the second port B as well as the third port C and the fourth port D communicate with each other.

As a result, the refrigerant discharged from the first compressor 120 sequentially flows into the refrigerant discharge pipe 125, the first four-way valve 124, the in-unit gas pipe 126, and the first outdoor heat exchangers 121 and 121, is condensed and liquefied in the first outdoor heat exchangers 121 and 121 and then, flows into the fluid pipe 8 of the inter-unit pipeline 5 through the first in-unit fluid pipe 129. On the other hand, the refrigerant discharged from the second compressor 30 sequentially flows into the refrigerant discharge pipe 37, the four-way valve 31, and the second outdoor heat exchanger 32, is condensed and liquefied in this second outdoor heat exchanger 32 and then, flows into the fluid pipe 8 of the inter-unit pipeline 5 through the fluid pipe 36 and merges with the refrigerant flowing out of the first outdoor unit 102 in this fluid pipe 8.

The liquid refrigerant flowing through the fluid pipe 8 is distributed to the indoor expansion valves 11A to 11D of the indoor units 4A to 4D and is decompressed therein. Then, the decompressed refrigerant is evaporated and vaporized in each of the indoor heat exchangers 10A to 10D and then, flows into the low-pressure gas pipe 6 through the second opening/closing valves 16A to 16D and the low-pressure gas branch pipes 14A to 14D, respectively, and is distributed into two parts in this low-pressure gas pipe 6.

One of the refrigerants flows into the first outdoor unit 102 and is sucked into the first compressor 120 through the refrigerant sucking branch pipe 128A and the refrigerant sucking pipe 128. Also, the other refrigerant flows into the second outdoor unit 3 through the second four-way valve 51 of the valve-element kit 50 and the gas pipe 35 and is sucked into the second compressor 30 through the four-way valve 31 and the refrigerant sucking pipe 41. As mentioned above, all the indoor units 4A to 4D are cooled at the same time by the indoor heat exchangers 10A to 10D working as evaporators.

Figure 8:
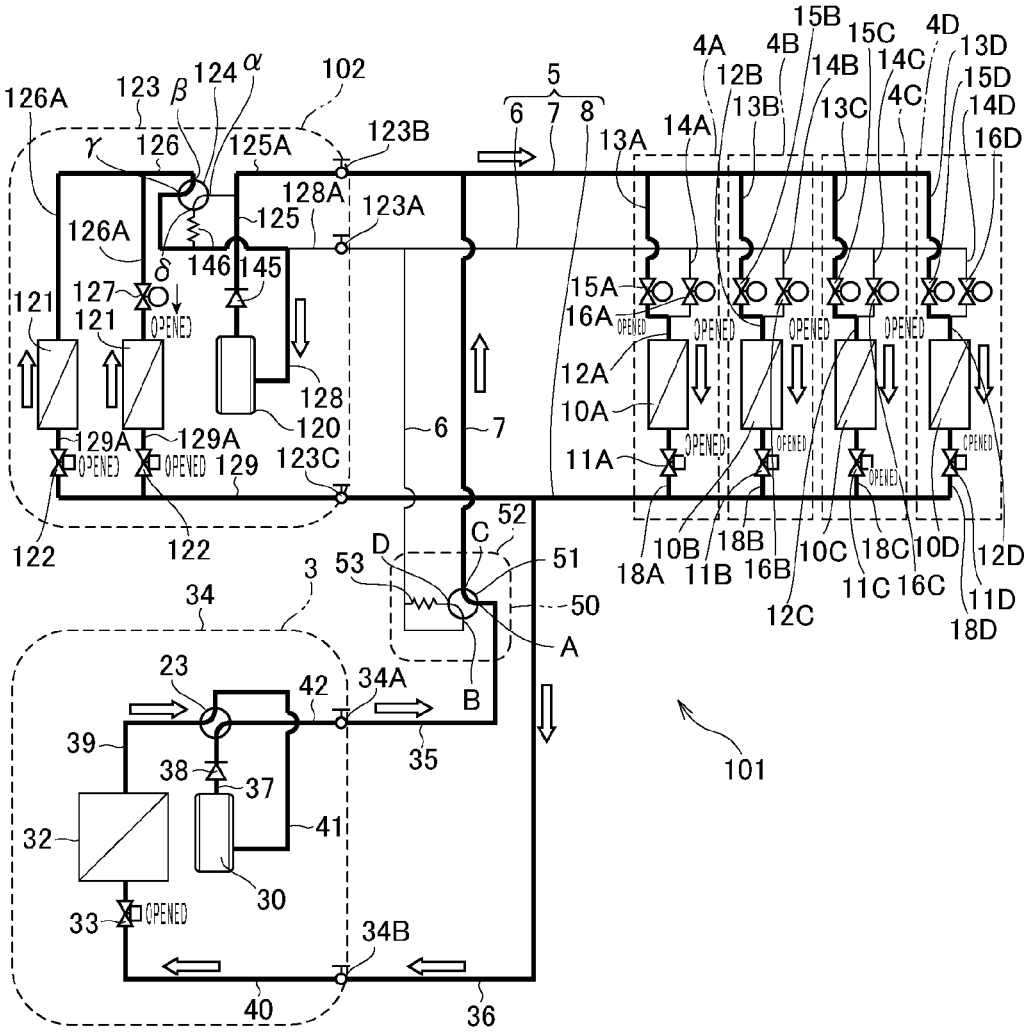
FIG. 8 is a circuit diagram illustrating the flow of the refrigerant when the air conditioner performs a heating operation.

In the case of the heating operation of all the indoor units 4A to 4D at the same time, the low-pressure gas pipe 6 is brought into the sleep state. In this case, as shown in FIG. 8, in the first outdoor unit 102, the first four-way valve 124 is switched to a position (first switching position) where the first outdoor heat exchangers 121 and 121 communicate with the refrigerant sucking pipe 128, that is, the position where the first port α and the fourth port δ as well as the second port β and the third port γ of the first four-way valve 124 communicate with each other, and the electromagnetic opening/closing valve 127 is opened, and opening degrees of the first expansion valves 122 and 122 are adjusted according to the air-conditioning load. Also, in the second outdoor unit 3, the four-way valve 31 is switched to the position of the heating operation where the discharged refrigerant of the second compressor 30 is led to the gas pipe 35. Also, in all the indoor units 4A to 4D, the first opening/closing valves 15A to 15D are opened, while the second opening/closing valves 16A to 16D are closed. Also, in the valve-element kit 50, the second four-way valve 51 is switched to the position where the first port A and the third port C as well as the second port B and the fourth port D communicate with each other.

As a result, the refrigerant discharged from the first compressor 120 flows into the high-pressure gas pipe 7 of the inter-unit pipeline 5 through the refrigerant discharge pipe 125 and the refrigerant discharge branch pipe 125A. On the other hand, the refrigerant discharged from the second compressor 30 flows into the high-pressure gas pipe 7 of the inter-unit pipeline 5 through the refrigerant discharge pipe 37, the four-way valve 31, the in-unit gas pipe 42, the gas pipe 35, and the second four-way valve 51 of the valve-element kit 50 and merges with the refrigerant flowing out of the first outdoor unit 2 in this high-pressure gas pipe 7.

The gas refrigerant flowing through the high-pressure gas pipe 7 is distributed to the high-pressure gas branch pipes 13A to 13D of the indoor units 4A to 4D and then, flows into the first opening/closing valves 15A to 15D and the indoor heat exchangers 10A to 10D and is condensed and liquefied therein, respectively. The liquefied liquid refrigerant flows into the fluid pipe 8 through the fluid branch pipes 18A to 18D, and the liquid refrigerant is distributed to two parts in this fluid pipe 8.

One of the refrigerants flows into the first outdoor unit 102, is distributed to each of the first expansion valves 122 and 122 and decompressed therein. Then, the decompressed refrigerants are evaporated and vaporized in the first outdoor heat exchangers 121 and 121 and then, merge in the in-unit gas pipe 126 and the merged refrigerant is sucked into the first compressor 120 through the first four-way valve 124 and the refrigerant sucking pipe 128. The other refrigerant flows into the second outdoor unit 3 through the fluid pipe 36 and is decompressed by the second expansion valve 33. Then, the decompressed refrigerant is evaporated and vaporized in the second outdoor heat exchanger 32 and then, is sucked into the second compressor 30 through the four-way valve 31 and the refrigerant sucking pipe 41. As mentioned above, all the indoor units 4A to 4D are heated at the same time by the indoor heat exchangers 10A to 10D working as condensers.

In the case of the cooling-heating mixed operation with an emphasis on the cooling of the indoor units 4A to 4D, if the indoor units 4A to 4C perform the cooling operation and the indoor unit 4D performs the heating operation, for example, the low-pressure gas pipe 6, the high-pressure gas pipe 7, and the fluid pipe 8 are all used.

Figure 9:
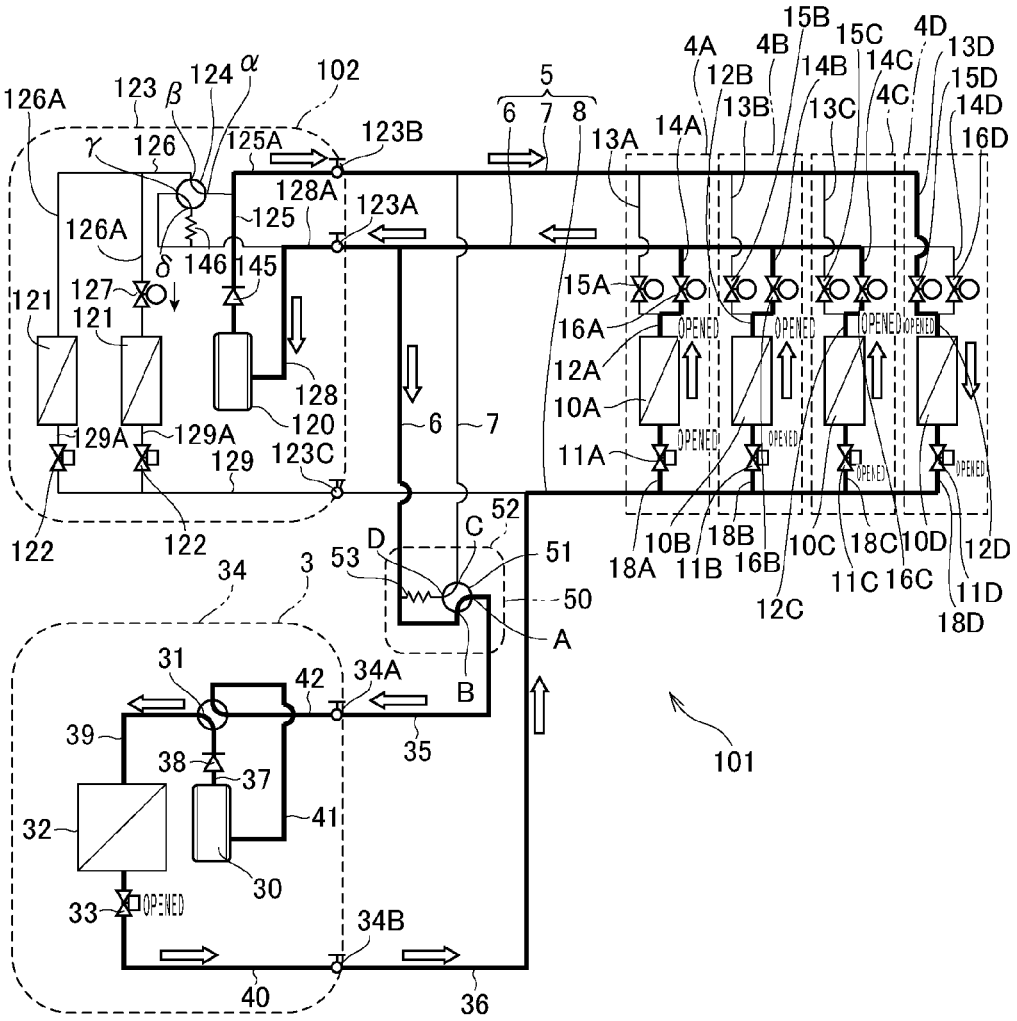
FIG. 9 is a circuit diagram illustrating the flow of the refrigerant when the air conditioner performs a mixed operation of cooling and heating with an emphasis on the cooling.

In this case, as shown in FIG. 9, in the first outdoor unit 102, the first four-way valve 124 is switched to the second switching position, the first expansion valves 122 and 122 are both closed, and the refrigerant does not flow into the first outdoor heat exchangers 121 and 121. That is because cooling loads in the indoor units 4A to 4C balanced with a heating load in the indoor unit 4D are borne by the first outdoor unit 102, while the excess cooling load is borne by the second outdoor unit 3, whereby a refrigerating cycle is formed.

Also, in the second outdoor unit 3, the four-way valve 31 is switched to the position of the cooling operation where the discharged refrigerant of the second compressor 30 is led to the second outdoor heat exchanger 32. Also, in the indoor units 4A to 4C, the first opening/closing valves 15A to 15C are closed, the second opening/closing valves 16A to 16C are opened, and in the indoor unit 4D, the first opening/closing valve 15D is opened, and the second opening/closing valve 16D is closed. Also, in the valve-element kit 50, the second four-way valve 51 is switched to the position where the first port A and the second port B as well as the third port C and the fourth port D communicate with each other.

As a result, the refrigerant discharged from the first compressor 120 flows into the indoor unit 4D through the refrigerant discharge pipe 125, the refrigerant discharge branch pipe 125A, and the high-pressure gas pipe 7. The refrigerant having flown into the indoor unit 4D flows into the indoor heat exchanger 10D through the high-pressure gas branch pipe 13D and the first opening/closing valve 15D, is condensed and liquefied therein and then, flows into the fluid pipe 8 through the fluid branch pipe 18D.

On the other hand, the refrigerant discharged from the second compressor 30 sequentially flows to the refrigerant discharge pipe 37, the four-way valve 31, and the second outdoor heat exchanger 32, is condensed and liquefied in this second outdoor heat exchanger 32 and then, flows into the fluid pipe 8 of the inter-unit pipeline 5 through the fluid pipe 36 and merges with the refrigerant flowing out of the first outdoor unit 2 in this fluid pipe 8.

The liquid refrigerant flowing through the fluid pipe 8 is distributed to the indoor expansion valves 11A to 11C of the indoor units 4A to 4C and decompressed therein. Then, the decompressed refrigerant is evaporated and vaporized in each of the indoor heat exchangers 10A to 10C and then, flows into the low-pressure gas pipe 6 through the second opening/closing valves 16A to 16C and the low-pressure gas branch pipes 14A to 14C, respectively, and is distributed into two parts in this low-pressure gas pipe 6.

One of the refrigerants flows into the first outdoor unit 102 and is sucked into the first compressor 120 through the refrigerant sucking branch pipe 128A and the refrigerant sucking pipe 128. Also, the other refrigerant flows into the second outdoor unit 3 through the second four-way valve 51 of the valve-element kit 50 and the gas pipe 35 and is sucked into the second compressor 30 through the four-way valve 31 and the refrigerant sucking pipe 41. As mentioned above, the indoor units 4A to 4C are cooled in the indoor heat exchangers 10A to 10C working as evaporators, respectively, while the indoor unit 4D is heated in the other indoor heat exchanger 10D working as a condenser.

In this configuration, the second outdoor unit 3 is connected to the inter-unit pipeline 5 through the valve-element kit 50, and the refrigerant condensed by the second outdoor heat exchanger 32 of the second outdoor unit 3 merges with the refrigerant condensed in the indoor heat exchanger 10D in the fluid pipe 8. Thus, in the case of the cooling-heating mixed operation, since condensing pressures (condensing temperatures) can be set independently for the indoor heat exchanger 10D and the second outdoor heat exchanger 32 working as condensers, if the outdoor temperature is low as in the winter, for example, the condensing pressure of the second outdoor heat exchanger 32 can be kept lower than the condensing pressure of the indoor heat exchanger 10D, whereby the workload (power consumption) of the second compressor 30 can be reduced.

Figure 10:
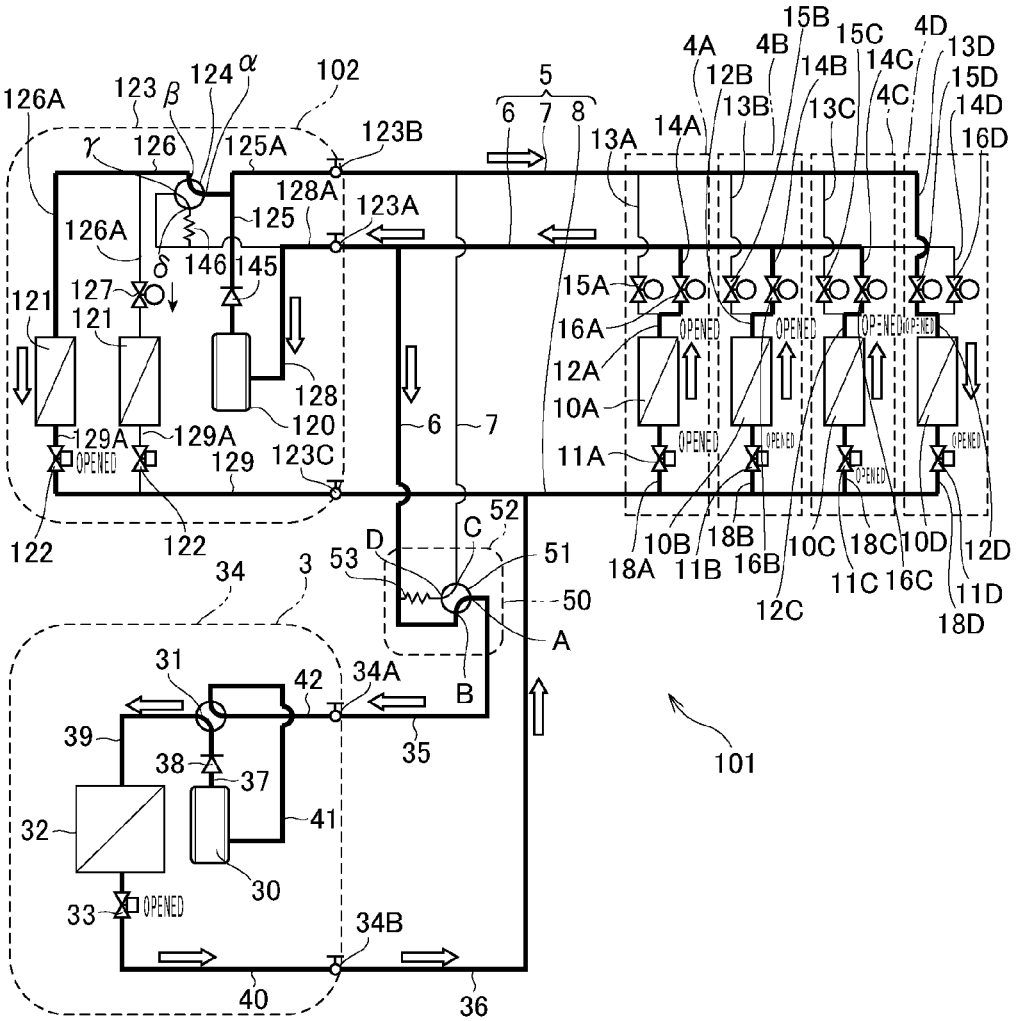
FIG. 10 is a circuit diagram illustrating a flow of the refrigerant when a part of first outdoor heat exchangers is used as condensers in FIG. 9.

Also, if cooling loads of the indoor units 4A to 4C are increased and cannot be handled by the second outdoor heat exchanger 32 of the second outdoor unit 3, as shown in FIG. 10, in the first outdoor unit 102, the electromagnetic opening/closing valve 127 is closed, the first expansion valve 122 on the in-unit branch gas pipe 126A on which the electromagnetic opening/closing valve 127 is not disposed is opened, and a part of the refrigerant discharged from the first compressor 120 is led to the first outdoor heat exchanger 121, whereby the first outdoor heat exchanger 121 can be made to work as a condenser.

In this configuration, the first outdoor unit 102 is provided with the two first outdoor heat exchangers 121 and 121 arranged in parallel, and by opening/closing the electromagnetic opening/closing valve 127, the refrigerant can be distributed and made to flow to each of the first outdoor heat exchangers 121 and 121, and thus, according to the load balance of the cooling load and the heating load during the cooling-heating mixed operation, the operation of the electromagnetic opening/closing valve 127 can be controlled so as to change the number of the first outdoor heat exchangers 121 and 121 used for the air-conditioning operation, whereby the operation efficiency during the air-conditioning operation can be improved. Also, by closing the electromagnetic opening/closing valve 127, the discharged refrigerant of the first compressor 120 is prevented from flowing into the first outdoor heat exchanger 121 on the side where this electromagnetic opening/closing valve 127 is disposed.

In the case of the cooling-heating mixed operation with the emphasis on the heating of the indoor units 4A to 4D, if the indoor unit 4A is made to perform the cooling operation and the indoor units 4A to 4D are made to perform the heating operation, for example, the low-pressure gas pipe 6, the high-pressure gas pipe 7, and the fluid pipe 8 are all used.

Figure 11:
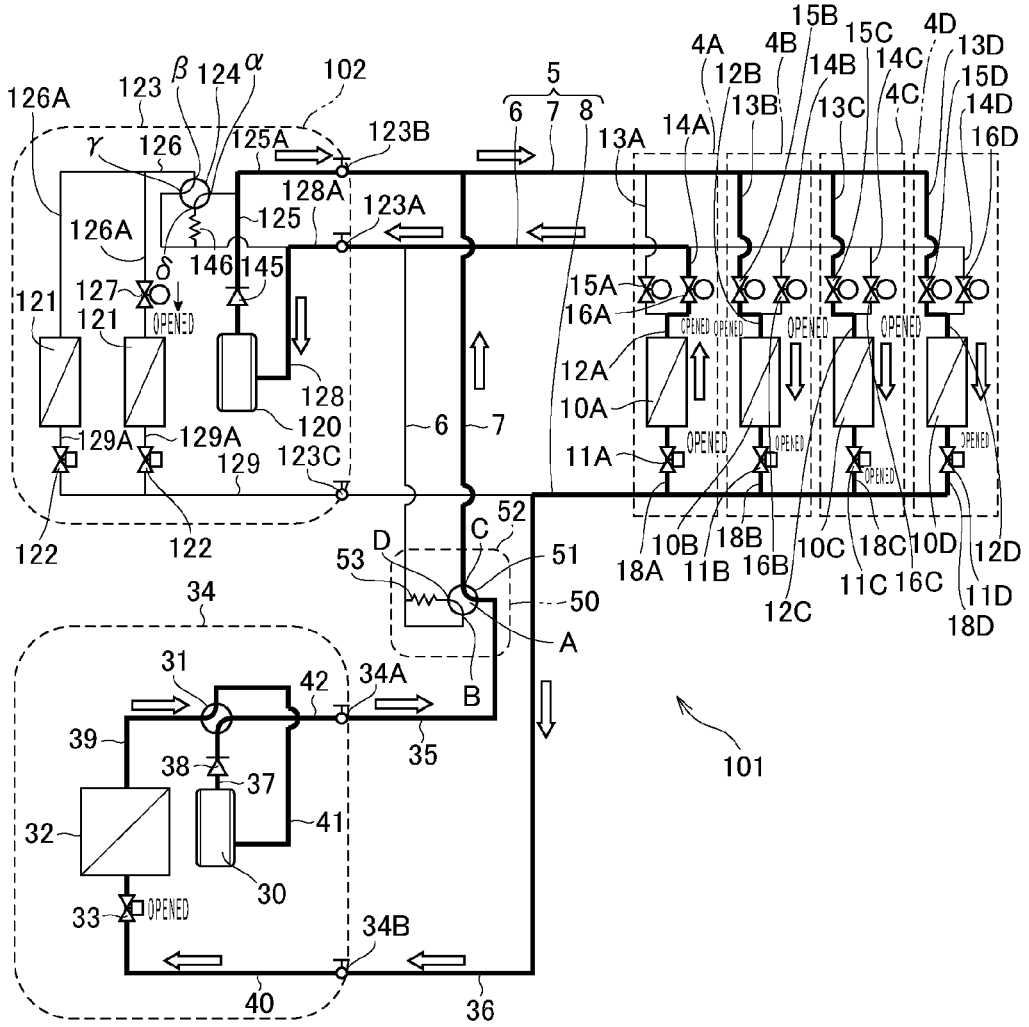
FIG. 11 is a circuit diagram illustrating the flow of the refrigerant when the air conditioner performs a mixed operation of cooling and heating with an emphasis on the heating.

In this case, as shown in FIG. 11, in the first outdoor unit 102, the first four-way valve 124 is switched to the first switching position, the first expansion valves 122 and 122 are both closed, and the refrigerant does not flow into the first outdoor heat exchangers 121 and 121.

Also, in the second outdoor unit 3, the four-way valve 31 is switched to the position of the heating operation where the discharged refrigerant of the second compressor 30 is led to the gas pipe 35. Also, in the indoor unit 4A, the first opening/closing valve 15A is closed and the second opening/closing valve 16A is opened, and in the indoor units 4B to 4D, the first opening/closing valves 15B to 15D are opened, and the second opening/closing valves 16B to 16D are closed. Also, in the valve-element kit 50, the second four-way valve 51 is switched to the position where the first port A and the third port C as well as the second port B and the fourth port D communicate with each other.

As a result, the refrigerant discharged from the first compressor 120 flows into the high-pressure gas pipe 7 of the inter-unit pipeline 5 through the refrigerant discharge pipe 125 and the refrigerant discharge branch pipe 125A. On the other hand, the refrigerant discharged from the second compressor 30 flows into the high-pressure gas pipe 7 of the inter-unit pipeline 5 through the refrigerant discharge pipe 37, the four-way valve 31, the in-unit gas pipe 42, the gas pipe 35, and the second four-way valve 51 of the valve-element kit 50 and merges with the refrigerant flowing out of the first outdoor unit 2 in this high-pressure gas pipe 7.

The gas refrigerant flowing through the high-pressure gas pipe 7 is distributed to the high-pressure gas branch pipes 13B to 13D of the indoor units 4B to 4D and then, flows into the first opening/closing valves 15B to 15D and the indoor heat exchangers 10B to 10D and is condensed and liquefied therein. The liquefied liquid refrigerant flows into the fluid pipe 8 through the fluid branch pipes 18B to 18D.

A part of the liquid refrigerant having flown into this fluid pipe 8 flows into the indoor unit 4A, is decompressed by the indoor expansion valve 11A of the indoor unit 4A and the decompressed refrigerant is evaporated and vaporized in the indoor heat exchanger 10A. Then, the vaporized gas refrigerant flows into the first outdoor unit 2 through the second opening/closing valve 16A, the low-pressure gas branch pipe 14A, and the low-pressure gas pipe 6 and is sucked into the first compressor 20 through the refrigerant sucking branch pipe 28A and the refrigerant sucking pipe 28.

On the other hand, the remaining liquid refrigerant having flown into the liquid pipe 8 flows into the second outdoor unit 3 through the fluid pipe 36 and is decompressed by the second expansion valve 33. Then, the decompressed refrigerant is evaporated and vaporized in the second outdoor heat exchanger 32 and then, is sucked into the second compressor 30 through the four-way valve 31 and the refrigerant sucking pipe 41. As mentioned above, the indoor unit 4A is cooled by the indoor heat exchanger 10A working as an evaporator, while the indoor units 4B to 4D are heated by the other indoor heat exchangers 10B to 10D working as condensers, respectively.

In this configuration, since the second outdoor unit 3 is connected to the inter-unit pipeline 5 through the valve-element kit 50, a part of the refrigerant condensed in each of the indoor heat exchangers 10B to 10D of each of the indoor units 4B to 4D can be led to the indoor heat exchanger 10A of the indoor unit 4A, while the remaining refrigerant can be led to the second outdoor heat exchanger 32 of the second outdoor unit 3. Thus, in the case of the cooling-heating mixed operation, evaporation pressures (evaporation temperatures) of the indoor heat exchanger 10A and the second outdoor heat exchanger 32 working as evaporators can be set independently. Thus, if the outside temperature is low as in the winter, for example, the evaporation temperature of the indoor heat exchanger 10D can be set at an appropriate temperature higher than the evaporation temperature of the second outdoor heat exchanger 32 as compared with the evaporation temperature of the second outdoor heat exchanger 32, which is lowered with this outdoor temperature. As a result, since drop of the evaporation temperature of the indoor heat exchanger 10D due to an influence of the outdoor temperature as before is prevented, means that prevents freezing of the indoor heat exchanger 10D is no longer required.

Figure 12:
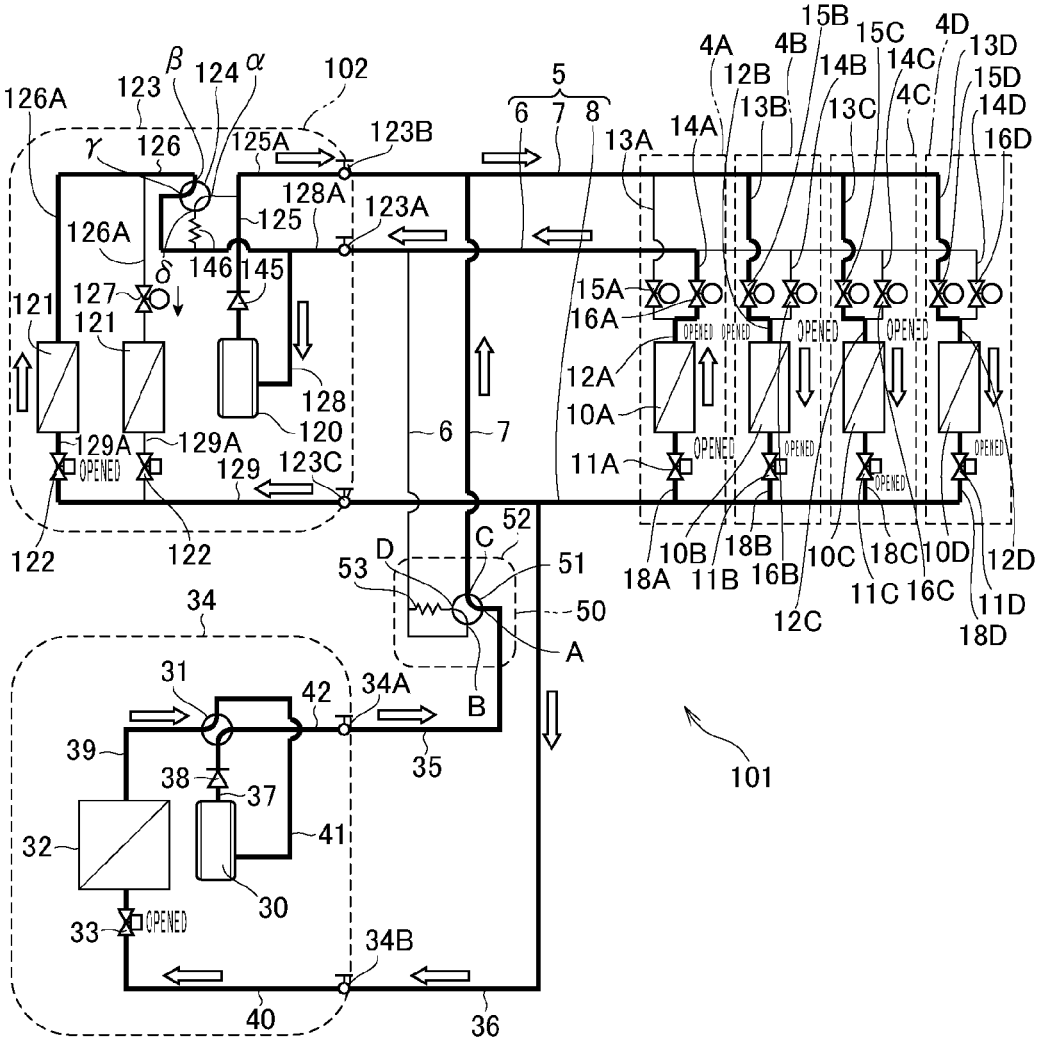
FIG. 12 is a circuit diagram illustrating a flow of the refrigerant when a part of the first outdoor heat exchangers is used as evaporators in FIG. 11.

Also, if the heating loads of the indoor units 4B to 4D are increased and cannot be borne by the second outdoor heat exchanger 32 of the second outdoor unit 3, as shown in FIG. 12, in the first outdoor unit 102, the electromagnetic opening/closing valve 127 is closed, the first expansion valve 122 on the in-unit branch gas pipe 126A in which this electromagnetic opening/closing valve 127 is not disposed is opened so that a part of the refrigerant discharged from the first compressor 120 is led to the first outdoor heat exchanger 121, whereby the first outdoor heat exchanger 121 can be made to work as an evaporator.

In this configuration, the first outdoor unit 102 is provided with the two first outdoor heat exchangers 121 and 121 provided in parallel and the refrigerant can be distributed and made to flow to each of the first outdoor heat exchangers 121 and 121, and thus, the number of the first outdoor heat exchangers 121 and 121 used in the air-conditioning operation can be changed by controlling the operation of the electromagnetic opening/closing valve 127 according to the load balance of the cooling load and the heating load during the cooling-heating mixed operation so that the operation efficiency during the air-conditioning operation can be improved.

As mentioned above, according to this embodiment, the first outdoor unit 102 having the first compressor 120, the first four-way valve 124, and the first outdoor heat exchangers 121 and 121, the inter-unit pipeline 5 having the high-pressure gas pipe 7 connected to the refrigerant discharge branch pipe 125A branching from between the first compressor 120 and the first four-way valve 124, the low-pressure gas pipe 6 connected to the refrigerant sucking branch pipe 128A branching from the refrigerant sucking pipe 128 of the first compressor 120, and the fluid pipe 8 connected to the first outdoor heat exchangers 121 and 121 through the first in-unit fluid pipe 129, and a plurality of the indoor units 4A to 4D connected to the high-pressure gas pipe 7, the low-pressure gas pipe 6, and the fluid pipe 8 of the inter-unit pipeline 5 and having the indoor heat exchangers 10A to 10D are provided, in which the first four-way valve 124 makes the low-pressure gas pipe 6 communicate with the first outdoor heat exchangers 121 and 121 at the first switching position and makes the first compressor 120 communicate with the first outdoor heat exchanges 121 and 121 at the second switching position and thus, the first outdoor unit 102 connected to the three inter-unit pipelines 5 can be constructed only by partially changing the piping configuration of the so-called double-pipeline type existing outdoor unit having the compressor, the four-way valve, and the outdoor heat exchanger so that a production cost can be reduced as compared with a case in which the triple-pipeline type outdoor unit is independently developed.

Also, since the first outdoor unit 102 is constituted on the basis of the so-called double-pipeline type outdoor unit, size reduction of the first outdoor unit 102 can be realized as compared with the prior-art triple-pipeline type outdoor unit.

Also, according to this embodiment, the refrigerant discharge pipe 125 of the first compressor 120 is connected to the first port α of the first four-way valve 124, the first outdoor heat exchangers 121 and 121 are connected to the second port β, the refrigerant sucking pipe 128 is connected to the third port γ, and the refrigerant sucking pipe 128 is connected to the fourth port δ through the capillary tube 146, and thus, the first compressor 120, the first outdoor heat exchangers 121 and 121, the high-pressure gas pipe 7, and the low-pressure gas pipe 6 can be connected through this first four-way valve 124. Therefore, without requiring a complicated piping configuration as before, only with a simple operation in which the first four-way valve 124 is switched to the first switching position and the second switching position, the plurality of the indoor units 4A to 4D can be made to perform the cooling operation or the heating operation at the same time or the heating operation and the cooling operation can be performed in a mixed manner.

Also, according to this embodiment, since the first outdoor unit 102 is provided with a plurality of the first outdoor heat exchangers 121 and 121 in parallel and the electromagnetic opening/closing valve 127 is disposed between at least one first outdoor heat exchanger 121 and the first four-way valve 124, the number of the first outdoor heat exchangers 121 and 121 used in the air-conditioning operation can be adjusted by controlling the operation of the electromagnetic opening/closing valve 127 according to the load balance of the cooling load and the heating load during the cooling-heating mixed operation so that the operation efficiency in the air-conditioning operation can be improved.

Also, according to this embodiment, the second outdoor unit 3 having the second compressor 30 and the second outdoor heat exchangers 32 and connected by the two pipelines of the gas pipe 35 and the fluid pipe 36, is provided, in which the fluid pipe 36 of the second outdoor unit 3 is connected to the fluid pipe 8 of the inter-unit pipeline 5 and the gas pipe 35 of the second outdoor unit 3 is selectively connected to the high-pressure gas pipe 7 or the low-pressure gas pipe 6 of the inter-unit pipeline 5 using the valve-element kit 50 having the second four-way valve 51, and thus, the second outdoor unit 3 constituted by the so-called double-pipeline type outdoor unit can be connected to the three inter-unit pipelines 5. Therefore, the second outdoor unit 3 connected to the triple-pipeline type air conditioner 1 can be constituted inexpensively using the existing double-pipeline type outdoor unit so that the price of the entire air conditioner 101 can be reduced.

Also, according to this embodiment, the valve-element kit 50 is provided with the single second four-way valve 51, the gas pipe 35 is connected to the first port A of this second four-way valve 51, the low-pressure gas pipe 6 is connected to the second port B, the high-pressure gas pipe 7 is connected to the third port C, and the low-pressure gas pipe 6 is connected to the fourth-port D through the capillary tube 53, and thus, with the simple configuration in which the second four-way valve 51 is interposed, the gas pipe 35 of the second outdoor unit 3 can be selectively connected to the high-pressure gas pipe 7 or the low-pressure gas pipe 6 of the inter-unit pipeline 5, and the second outdoor unit 3 constituted by the so-called double-pipeline type outdoor unit can be connected to the triple-pipeline type air conditioner 101.

Also, according to this embodiment, since the valve-element kit 50 is disposed outside the second unit case 34 of the second outdoor unit 3, the existing double-pipeline type outdoor unit can be used as the second outdoor unit 3 as it is without changing the pipeline configuration thereof, and the configuration of the triple pipeline type air conditioner 101 can be simplified.

The present invention has been described above on the basis of the above embodiment, but the present invention is not limited to that. For example, in this embodiment, the air conditioner 101 is configured to be provided with the first outdoor unit 102 and the second outdoor unit 3, but it may be so configured that only one first outdoor unit 102 is provided or that a plurality of the first outdoor units 102 are provided.

Also, in this embodiment, the valve-element kit 50 is configured to be provided with the second four-way valve 51 as a channel switching valve, but not limited to that, a plurality of electromagnetic opening/closing valves may be combined.

The invention claimed is:

1. An air conditioner comprising:

a triple-pipeline first outdoor unit provided with a first compressor, a first outdoor heat exchanger, and a first outdoor expansion valve and connected by a refrigerant discharge pipe, a refrigerant sucking pipe and a first in-unit fluid pipe;

a plurality of indoor units provided with a plurality of indoor heat exchangers and connected by an inter-unit pipeline, a first end of the first outdoor heat exchanger selectively branched and connected to the refrigerant discharge pipe and the refrigerant sucking pipe of the first compressor, the inter-unit pipeline including a high-pressure gas pipe connected to the refrigerant discharge pipe, a low-pressure gas pipe connected to the refrigerant sucking pipe, and a fluid pipe connected to the first in-unit fluid pipe at a second end of the first outdoor heat exchanger, a first end of each of the plurality of indoor heat exchangers is selectively branched and connected to the high-pressure gas pipe and the low-pressure gas pipe, and a second end of each of the plurality of indoor heat exchangers is connected to the fluid pipe through a fluid branch pipe so that the plurality of the indoor units can perform a cooling operation or a heating operation at the same time or the cooling operation and the heating operation can be performed in a mixed manner; and a double-pipeline second outdoor unit provided with a second compressor, a second outdoor heat exchanger, and a second outdoor expansion valve and connected by two pipelines of a gas pipe and a fluid pipe, wherein the fluid pipe of the second outdoor unit is connected to the fluid pipe of the inter-unit pipeline, the high-pressure gas pipe is configured to be connected to the refrigerant discharge pipe in cases of the cooling and heating operations, a valve-element kit having a channel switching valve that selectively connects the gas pipe of the double-pipeline second outdoor unit to the high-pressure gas pipe or the low-pressure gas pipe of the inter-unit pipeline is provided, the channel switching valve is a single four-way valve, in which the gas pipe of the double-pipeline second outdoor unit is connected to a first port of the single four-way valve, the low-pressure gas pipe is connected to a second port of the single four-way valve, the high-pressure gas pipe is connected to a third port of the single four-way valve, and the low-pressure gas pipe is connected to a fourth port of the single four-way valve through a capillary tube, and the gas pipe of the double-pipeline second outdoor unit is connected to the high-pressure gas pipe or the low-pressure gas pipe of the inter-unit pipeline only through the single four-way valve.

2. The air conditioner according to claim 1, wherein the valve-element kit is provided outside a housing of the double-pipeline second outdoor unit.

3. The air conditioner according to claim 1, wherein the first compressor has a capacity of at least a half of all the compressors provided in the air conditioner.

4. The air conditioner according to claim 1, wherein the triple-pipeline first outdoor unit is provided with a plurality of the first outdoor heat exchangers disposed in parallel, one end of each first outdoor heat exchanger is connected to the refrigerant discharge pipe and the refrigerant sucking pipe through a refrigerant discharge pipe branch pipe and a refrigerant sucking pipe branch pipe, respectively, and an electromagnetic opening / closing valve is disposed at the refrigerant discharge pipe branch pipe and the refrigerant sucking pipe branch pipe, respectively.

5. The air conditioner according to claim 1, wherein one end of each of the plurality of indoor heat exchangers is connected to the high-pressure gas pipe and the low-pressure gas pipe through a high-pressure gas branch pipe and a low-pressure gas branch pipe, respectively, and an electromagnetic opening / closing valve is disposed at the high-pressure gas branch pipe and the low-pressure gas branch pipe, respectively.

6. The air conditioner according to claim 1, wherein the first outdoor unit is provided with a first unit case that contains the first compressor, the first outdoor heat exchanger, and the first expansion valve, the refrigerant discharge pipe of the first outdoor unit is branched to a first refrigerant discharge pipe and a second refrigerant discharge pipe inside the first unit case, the first refrigerant discharge pipe is connected to the first end of the first outdoor heat exchanger, the second refrigerant discharge pipe, the refrigerant sucking pipe, and the first in-unit fluid pipe of the first outdoor unit are connected to the high-pressure gas pipe, the low-pressure gas pipe, and the fluid pipe of the inter-unit pipeline, respectively, and the high-pressure gas pipe, the low-pressure gas pipe, and the fluid pipe of the inter-unit pipeline are connected to the gas pipe and the fluid pipe of the second outdoor unit through the four-way valve.

* * * * *